US011118327B2

(12) United States Patent
Kobayashi et al.

(10) Patent No.: US 11,118,327 B2
(45) Date of Patent: Sep. 14, 2021

(54) WORK MACHINE

(71) Applicant: Hitachi Construction Machinery Co., Ltd., Tokyo (JP)

(72) Inventors: Hiroyuki Kobayashi, Tokyo (JP); Yoshiyuki Tsuchie, Tsuchiura (JP); Hidekazu Moriki, Tokyo (JP); Hiroshi Sakamoto, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/057,414

(22) PCT Filed: Jun. 11, 2019

(86) PCT No.: PCT/JP2019/023120
§ 371 (c)(1),
(2) Date: Nov. 20, 2020

(87) PCT Pub. No.: WO2019/240133
PCT Pub. Date: Dec. 19, 2019

(65) Prior Publication Data

US 2021/0207345 A1 Jul. 8, 2021

(30) Foreign Application Priority Data

Jun. 11, 2018 (JP) ..... JP2018-110845

(51) Int. Cl.
*E02F 9/22* (2006.01)
*F15B 21/045* (2019.01)
(Continued)

(52) U.S. Cl.
CPC ..... *E02F 9/2285* (2013.01); *E02F 9/2221* (2013.01); *E02F 9/2267* (2013.01);
(Continued)

(58) Field of Classification Search
CPC ..... E02F 9/2285; E02F 9/2221; E02F 9/2267; F15B 11/08; F15B 11/028; F15B 21/045
See application file for complete search history.

(56) References Cited

U.S. PATENT DOCUMENTS

2016/0369480 A1* 12/2016 Mizuochi ..... E02F 9/2207
2018/0305898 A1 10/2018 Kobayashi et al.
2021/0018942 A1* 1/2021 Tsuchie ..... G05D 16/08

FOREIGN PATENT DOCUMENTS

JP 5-79503 A 3/1993
JP 2015-1751 A 10/2015
(Continued)

OTHER PUBLICATIONS

International Preliminary Report on Patentability (PCT/IB/338 & PCT/IB/373) issued in PCT Application No. PCT/JP2019/023120 dated Dec. 24, 2020, including English translation of document C2 (Japanese-language Written Opinion (PCT/ISA/237), filed on Nov. 20, 2020) (six (6) pages).
(Continued)

*Primary Examiner* — Abiy Teka
*Assistant Examiner* — Daniel S Collins
(74) *Attorney, Agent, or Firm* — Crowell & Moring LLP

(57) ABSTRACT

Provided is a work machine with which responsiveness of a hydraulic actuator can be improved when driving the hydraulic actuator through an electric lever-type operation device. A controller 100 further includes: an operation direction determining section 116 configured to determine operation directions of operation devices 2*a* and 2*b*; and a standby pressure switching command section 117 configured to output a standby pressure switching command to a first target pilot pressure correction section 112 or a second target pilot pressure correction section 113 which corresponds to a solenoid proportional valve that does not correspond to the operation direction from among first solenoid
(Continued)

proportional valves 41*a*, 42*a*, 42*b*, 43*a*, 43*b*, and 44*a* and second solenoid proportional valves 41*b*, 42*c*, 42*d*, 43*c*, 43*d*, and 44*b*. The first target pilot pressure correction section and the second target pilot pressure correction section are configured to switch a first standby pressure α to a second standby pressure β set lower than the first standby pressure in a case in which the standby pressure switching command has been inputted.

3 Claims, 19 Drawing Sheets

(51) Int. Cl.
*F15B 11/028* (2006.01)
*F15B 11/08* (2006.01)

(52) U.S. Cl.
CPC ..... *F15B 11/028* (2013.01); *F15B 11/08* (2013.01); *F15B 21/045* (2013.01)

(56) References Cited

FOREIGN PATENT DOCUMENTS

JP 2017-110774 A 6/2017
JP 2017218790 A * 12/2017 ..... G05D 16/08

OTHER PUBLICATIONS

International Search Report (PCT/ISA/210) issued in PCT Application No. PCT/JP2019/023120 dated Sep. 17, 2019 with English translation (two (2) pages).
Japanese-language Written Opinion (PCT/ISA/237) issued in PCT Application No. PCT/JP2019/023120 dated Sep. 17, 2019 (three (3) pages).

* cited by examiner

OPERATION PATTERN OF
LEFT OPERATION LEVER

OPERATION PATTERN OF
RIGHT OPERATION LEVER

WORK MACHINE

TECHNICAL FIELD

The present invention relates to a work machine such as a hydraulic excavator, particularly to a work machine that includes an electric lever-type operation device.

BACKGROUND ART

A hydraulic excavator as one of work machines includes a lower track structure capable of self-traveling, an upper swing structure swingably provided on an upper side of the lower track structure, and a work device connected to the upper swing structure. The work device includes, for example, a boom rotatably connected to the upper swing structure, an arm rotatably connected to the boom, and a bucket rotatably connected to the arm. The boom, the arm, and the bucket are rotated by driving of a plurality of hydraulic cylinders (specifically, a boom cylinder, an arm cylinder, and a bucket cylinder). Each hydraulic actuator is driven by hydraulic fluid supplied from a hydraulic pump through a directional control valve of a hydraulic pilot type, for example.

An operation device operated by an operator includes a hydraulic pilot type one and an electric lever-type one. The hydraulic pilot type operation device has a plurality of pilot valves that correspond to respective operation directions from a neutral position of an operation lever and generate a pilot pressure according to an operation amount of the operation lever. The pilot valves each output a pilot pressure to an operation section (pressure receiving section) of a corresponding directional control valve, to drive the directional control valve.

On the other hand, the electric lever-type operation device has a plurality of potentiometers that correspond to respective operation directions from a neutral position of an operation lever and generate an operation signal (electrical signal) according to an operation amount of the operation lever. The operation device generates a command current according to an operation signal from the potentiometers and outputs the command current to a solenoid section of a corresponding solenoid proportional valve, to drive the solenoid proportional valve. The solenoid proportional valve generates a pilot pressure proportional to the command current and drives a corresponding directional control valve.

In recent years, increased use of information technology in a construction site has been progressing, and working by processing various kinds of sensor information has been a mainstream. In order to smoothly cope with the increased use of information technology, an electric lever type in which sensor information and driving of actuators can be collectively controlled with electrical signals is advantageous. However, since in the electric lever type, a solenoid proportional valve is driven to generate a pilot pressure after conversion of a lever operation amount into a command current, a response delay is generated when driving the solenoid proportional valve, and operability would be worsened, as compared to a hydraulic pilot type in which a pilot pressure is generated directly according to an operation amount of an operation lever. As a document disclosing a prior art technology by which a response delay of a solenoid proportional valve can be reduced, there is, for example, Patent Document 1.

Patent Document 1 describes a change-over device of a hydraulic change-over valve, for changing over the hydraulic change-over valve (directional control valve) according to contents of a command given by operation of operation means. The change-over device includes: a pilot hydraulic fluid source; a solenoid proportional pressure reducing valve (solenoid proportional valve) of which a primary side is connected to the pilot hydraulic fluid source; a solenoid selector valve that is connected to a secondary side of the solenoid proportional pressure reducing valve and a pilot port of the hydraulic change-over valve and that can be changed over to a neutral position for connecting the pilot port to a tank and an operation position for giving a secondary pressure of the solenoid proportional pressure reducing valve to the pilot port; and control means that receives a command signal from the operation means, that, when the command signal is a neutral command signal, holds the solenoid selector valve in the neutral position, causes such a minute current that flow control by the hydraulic change-over valve is not started to flow to a variable solenoid of the solenoid proportional pressure reducing valve, and gives dither thereto, and that, when the command signal is an operation command signal, changes over the solenoid selector valve to the operation position according to the command and causes a current according to a command operation amount to flow to the variable solenoid of the solenoid proportional pressure reducing valve.

According to the change-over device for the hydraulic change-over valve (directional control valve) described in Patent Document 1, when the command signal from the operation means is a neutral command signal, the solenoid selector valve is held in the neutral position, a minute current (hereinafter referred to as standby current) is caused to flow to the variable solenoid of the solenoid proportional pressure reducing valve (solenoid proportional valve), and dither is given thereto. As a result, a spool of the solenoid proportional pressure reducing valve is minutely vibrated in the neutral state, so that friction at a sliding section of the spool changes from static friction to dynamic friction. As a result, the spool is brought into a state of being started easily, so that the response delay of the solenoid proportional pressure reducing valve (solenoid proportional valve) when the operation means is changed over from the neutral position to the operation position can be reduced.

In addition, when the command signal from the operation means is changed from an operation command signal to a neutral command signal, the solenoid selector valve is changed over to the neutral position, so that the pilot port of the hydraulic change-over valve (directional control valve) is connected to the tank. As a result, the hydraulic change-over valve (directional control valve) is swiftly returned to the neutral position, so that the response delay of the hydraulic change-over valve (directional control valve) when the operation means is returned from the operation position to the neutral position can be reduced.

PRIOR ART DOCUMENT

Patent Document

Patent Document 1: JP-1993-79503-A

SUMMARY OF THE INVENTION

Problem to be Solved by the Invention

In the change-over device for the hydraulic change-over valve described in Patent Document 1, the solenoid selector valve is disposed between the solenoid proportional pressure reducing valve (solenoid proportional valve) that outputs a pilot pressure and the pilot port of the hydraulic change-over valve (directional control valve), and the pilot pressure outputted by the solenoid proportional pressure reducing valve is transmitted to the pilot port through the solenoid selector valve. Therefore, due to the response delay when driving the solenoid selector valve, the pilot pressure outputted by the solenoid proportional pressure reducing valve is not swiftly transmitted to the pilot port of the hydraulic change-over valve, start of the hydraulic change-over valve is delayed, and responsiveness of a hydraulic actuator may be spoiled.

For example, a hydraulic excavator is used for such work as bumping in which a back surface of a bucket is caused to hit the ground to tread down the earth and sand and to level the ground, and bucket sifting in which aggregates of excavated earth and sand are divided into minute pieces. In the bumping, a boom raising operation (an extending operation of a boom cylinder) and a boom lowering operation (a contracting operation of the boom cylinder) are repeated with a short cyclic period. On the other hand, in the bucket sifting, a bucket crowding operation (an extending operation of a bucket cylinder) and a bucket dumping operation (a contracting operation of the bucket cylinder) are repeated with a short cyclic period. An influence of a start delay of the hydraulic change-over valve (directional control valve) mentioned above becomes conspicuous in a work in which an operation direction of the hydraulic actuator is thus switched at high speed, causing operability for the operator to be worsened.

The present invention has been made in consideration of the above-mentioned problems. It is an object of the present invention to provide a work machine with which it is possible to enhance responsiveness of a hydraulic actuator when the hydraulic actuator is driven through an electric lever-type operation device.

Means for Solving the Problem

In order to achieve the above object, according to the present invention, there is provided a work machine including a hydraulic actuator, a hydraulic pilot type directional control valve that controls a flow of hydraulic fluid supplied to the hydraulic actuator, a first solenoid proportional valve that generates a pilot pressure for driving the directional control valve in one direction, a second solenoid proportional valve that generates a pilot pressure for driving the directional control valve in another direction, an operation device for operating the hydraulic actuator, and a controller that outputs a command current for the first solenoid proportional valve according to a first target pilot pressure as a target pilot pressure for the first solenoid proportional valve calculated based on an operation signal from the operation device, and outputs a command current for the second solenoid proportional valve according to a second target pilot pressure as a target pilot pressure for the second solenoid proportional valve calculated based on an operation signal from the operation device. The controller includes: a first target pilot pressure correction section configured to correct the first target pilot pressure to a first standby pressure set to be lower than a minimum driving pressure for the directional control valve in a case in which the first target pilot pressure is lower than the first standby pressure; and a second target pilot pressure correction section configured to correct the second target pilot pressure to the first standby pressure in a case in which the second target pilot pressure is lower than the first standby pressure. The controller further includes: an operation direction determining section configured to determine an operation direction of the operation device based on the operation signal; and a standby pressure switching command section configured to output a standby pressure switching command to the first target pilot pressure correction section or the second target pilot pressure correction section corresponding to the solenoid proportional valve not corresponding to the operation direction, from among the first solenoid proportional valve and the second solenoid proportional valve. The first target pilot pressure correction section and the second target pilot pressure correction section are configured to switch the first standby pressure to a second standby pressure set to be lower than the first standby pressure in a case in which the standby pressure switching command has been inputted.

According to the present invention configured as above, when the operation device is operated, the standby pressure outputted from the solenoid proportional valve that does not correspond to the operation direction of the operation device, from among the first solenoid proportional valve and the second solenoid proportional valve, is switched from the first standby pressure to the second standby pressure set lower than the first standby pressure. As a result, a back pressure at the time of driving a spool of the directional control valve is lowered, and driving of the spool becomes smoother, so that responsiveness of the hydraulic actuator can be enhanced.

Advantages of the Invention

According to the present invention, in a work machine in which a hydraulic actuator is operated through an electric lever-type operation device, responsiveness of the hydraulic actuator can be enhanced.

MODES FOR CARRYING OUT THE INVENTION

Figure 1:
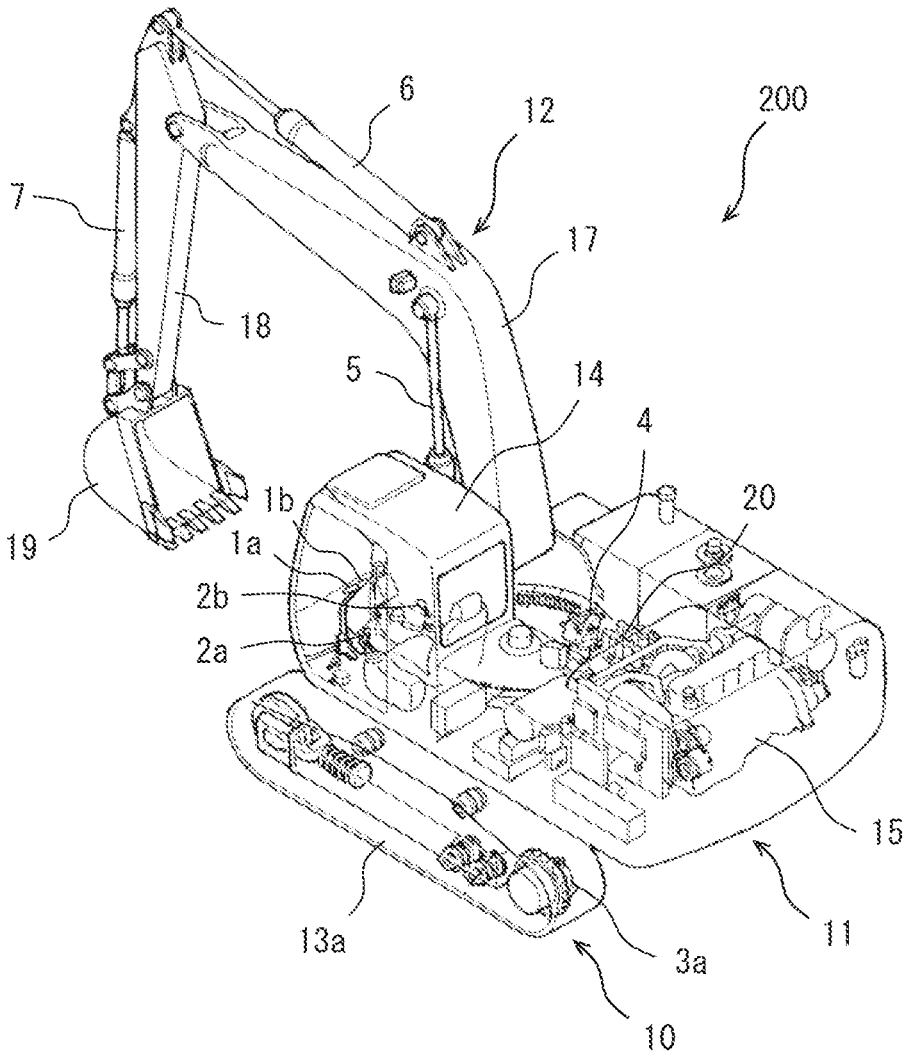
FIG. 1 is a perspective view depicting a structure of a hydraulic excavator according to a first embodiment of the present invention.

The present invention will be described below taking a hydraulic excavator as an example of a work machine according to embodiments of the present invention and referring to the drawings. Note that in the drawings, the equivalent members are denoted by the same reference characters, and overlapping descriptions will be omitted appropriately.

Embodiment 1

FIG. 1 is a perspective view depicting a structure of a hydraulic excavator according to a first embodiment of the present invention, and illustrates mounted devices partly in a see-through manner.

In FIG. 1, a hydraulic excavator 200 includes a lower track structure 10 capable of self-traveling, an upper swing structure 11 swingably provided on an upper side of the lower track structure 10, and a work device 12 connected to a front side of the upper swing structure 11.

The lower track structure 10 has left and right crawler type track devices 13*a* (in the figure, only the left-side one is illustrated). In the left-side track device 13*a*, a left crawler (crawler belt) is rotated in a forward direction or a backward direction by forward or backward rotation of a left track motor 3*a*. Similarly, in the right-side track device, a right crawler (crawler belt) is rotated in the forward direction or the backward direction by forward or backward rotation of a right track motor 3*b* (depicted in FIG. 2). As a result, the lower track structure 10 travels.

The upper swing structure 11 swings leftward or rightward by rotation of a swing motor 4. A cab 14 is provided at a front portion of the upper swing structure 11, and devices such as an engine 15 are mounted on a rear portion of the upper swing structure 11. Track operation devices 1*a* and 1*b* and work operation devices 2*a* and 2*b* are provided in the cab 14. In addition, a gate lock lever 16 (depicted in FIG. 2) capable of being operated up and down is provided at an entrance of the cab 14. The gate lock lever permits getting on and off of an operator when operated to a raised position, and inhibits getting on and off of the operator when operated to a lowered position.

A control valve 20 is for controlling flows (flow rates and directions) of hydraulic fluid supplied from hydraulic pumps 8*a*, 8*b*, and 8*c* (depicted in FIG. 2) to respective ones of the above-described hydraulic actuators such as a boom cylinder 5.

The work device 12 includes a boom 17 rotatably connected to the front side of the upper swing structure 11, an arm 18 rotatably connected to a tip portion of the boom 17, and a bucket 19 rotatably connected to a tip portion of the arm 18. The boom 17 is rotated upward or downward by extension or contraction of the boom cylinder 5. The arm 18 is rotated in a crowding direction (pulling-in direction) or a dumping direction (pushing-out direction) by extension or contraction of an arm cylinder 6. The bucket 19 is rotated in a crowding direction or a dumping direction by extension or contraction of a bucket cylinder 7.

Figure 2:
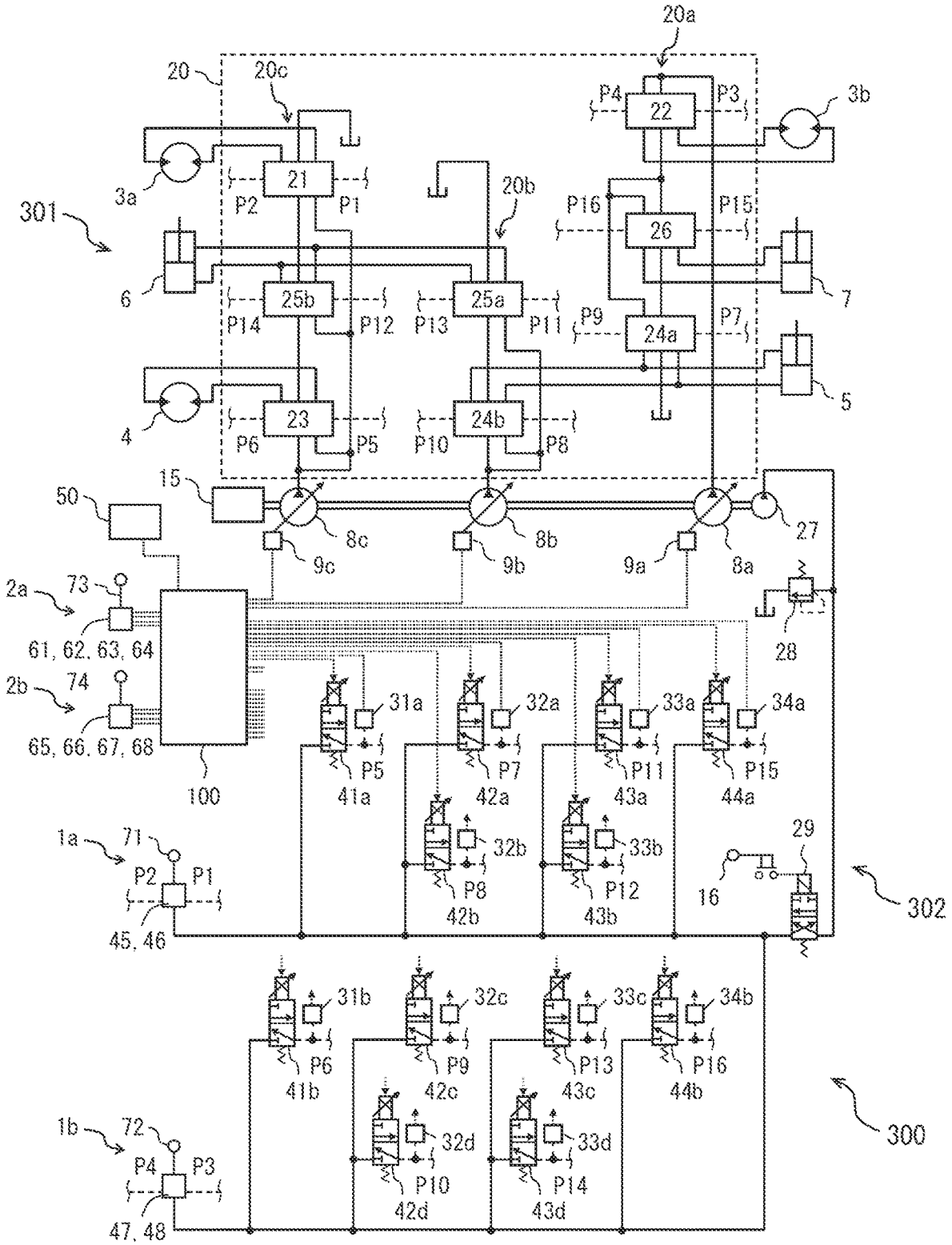
FIG. 2 is a diagram depicting a configuration of a drive system mounted on the hydraulic excavator according to the first embodiment of the present invention.

FIG. 2 is a diagram depicting a configuration of a drive system mounted on the hydraulic excavator 200 according to the first embodiment. Note that in FIG. 2, illustration of a main relief valve, a load check valve, a return circuit, a drain circuit, and the like is omitted for convenience' sake.

In FIG. 2, the drive system 300 generally includes a main hydraulic control circuit 301 and a pilot pressure control circuit 302.

The main hydraulic control circuit 301 includes variable displacement hydraulic pumps 8*a*, 8*b*, and 8*c* driven by the engine 15, a plurality of hydraulic actuators (specifically, the left track motor 3*a*, the right track motor 3*b*, the swing motor 4, the boom cylinder 5, the arm cylinder 6, and the bucket cylinder 7 mentioned above), and the control valve 20 having a plurality of hydraulic pilot type directional control valves (specifically, a left track directional control valve 21, a right track directional control valve 22, a swing directional control valve 23, boom directional control valves 24*a* and 24*b*, arm directional control valves 25*a* and 25*b*, and a bucket directional control valve 26). The hydraulic pumps 8*a*, 8*b*, and 8*c* are provided with regulators 9*a*, 9*b*, and 9*c*, respectively, for varying pump capacities.

All the directional control valves are center bypass type directional control valves, and are classified into a first valve group 20*a* connected to a delivery side of the hydraulic pump 8*a*, a second valve group 20*b* connected to a delivery side of the hydraulic pump 8*b*, and a third valve group 30*c* connected to a delivery side of the hydraulic pump 8*c*.

The first valve group 20*a* has the right track directional control valve 22, the bucket directional control valve 26, and the boom directional control valve 24*a*. Pump ports of the right track directional control valve 22 are connected in tandem to pump ports of the bucket directional control valve 26 and pump ports of the boom directional control valve 24*a*. The pump ports of the bucket directional control valve 26 and the pump ports of the boom directional control valve 24*a* are connected in parallel to each other. As a result, hydraulic fluid from the hydraulic pump 8*a* is supplied to the right track directional control valve 22 preferentially over the bucket directional control valve 26 and the boom directional control valve 24*a*.

The second valve group 20*b* has the boom directional control valve 24*b* and the arm directional control valve 25*a*. Pump ports of the boom directional control valve 24*b* and pump ports of the arm directional control valve 25*a* are connected in parallel to each other.

The third valve group 20*c* has the swing directional control valve 23, the arm directional control valve 25*b*, and the left track directional control valve 21. Pump ports of the swing directional control valve 23, pump ports of the arm directional control valve 25*b*, and pump ports of the left track directional control valve 21 are connected in parallel to one another.

The pilot pressure control circuit 302 includes a pilot pump 27 driven by the engine 15, the hydraulic pilot type track operation devices 1*a* and 1*b*, the electric lever type work operation devices 2*a* and 2*b*, a plurality of solenoid proportional valves (specifically, swing solenoid proportional valves 41*a* and 41*b*, boom solenoid proportional valves 42*a*, 42*b*, 42*c*, and 42*d*, arm solenoid proportional valves 43*a*, 43*b*, 43*c*, and 43*d*, and bucket solenoid proportional valves 44*a* and 44*b*), and a controller 100 that controls these solenoid proportional valves.

The left-side track operation device 1*a* has a left track lever 71 including an operation lever capable of being operated in a front-rear direction, and first and second pilot valves 45 and 46 that reduce a delivery pressure of the pilot pump 27 to generate a pilot pressure.

The first pilot valve 45 generates a pilot pressure according to an operation amount on the front side from a neutral position of the left track lever 71, and applies the pilot pressure to an operation section (pressure receiving section) on one side of the left track directional control valve 21 through a pilot line P1, to drive a spool of the left track directional control valve 21 toward the other side. As a result, hydraulic fluid from the hydraulic pump 8*c* is supplied through the left track directional control valve 21 to the left track motor 3*a*, so that the left track motor 3*a* is rotated forward.

The second pilot valve 46 generates a pilot pressure according to an operation amount on the rear side from the neutral position of the left track lever 71, and applies the pilot pressure to an operation section on the other side of the left track directional control valve 21 through a pilot line P2, to drive the spool of the left track directional control valve 21 toward one side. As a result, hydraulic fluid from the hydraulic pump 8*c* is supplied through the left track directional control valve 21 to the left track motor 3*a*, so that the left track motor 3*a* is rotated rearward.

Similarly, the right-side track operation device 1*b* has a right track lever 72 including an operation lever capable of being operated in the front-rear direction, and third and fourth pilot valves 47 and 48 that reduce the delivery pressure of the pilot pump 27 to generate a pilot pressure.

The third pilot valve 47 generates a pilot pressure according to an operation amount on the front side from a neutral position of the right track lever 72, and applies the pilot pressure to an operation section on one side of the right track directional control valve 22 through a pilot line P3, to drive a spool of the right track directional control valve 22 toward the other side. As a result, hydraulic fluid from the hydraulic pump 8*a* is supplied through the right track directional control valve 22 to the right track motor 3*b*, so that the right track motor 3*b* is rotated forward.

The fourth pilot valve 48 generates a pilot pressure according to an operation amount on the rear side from the neutral position of the right track lever 72, and applies the pilot pressure to an operation section on the other side of the right track directional control valve 22 through a pilot line P4, to drive the spool of the right track directional control valve 22 toward one side. As a result, hydraulic fluid from the hydraulic pump 8*a* is supplied through the right track directional control valve 22 to the right track motor 3*b*, so that the right track motor 3*b* is rotated rearward.

The left-side work operation device 2*a* has a left operation lever 73 including an operation lever capable of being operated in the front-rear direction and a left-right direction, and first to fourth potentiometers 61 to 64. The first potentiometer 61 generates an operation signal (electrical signal) according to an operation amount on the front side from a neutral position of the left operation lever 73, and outputs the operation signal to the controller 100. The second potentiometer 62 generates an operation signal according to an operation amount on the rear side from the neutral position of the left operation lever 73, and outputs the operation signal to the controller 100. The third potentiometer 63 generates an operation signal according to an operation amount on the left side from the neutral position of the left operation lever 73, and outputs the operation signal to the controller 100. The fourth potentiometer 64 generates an operation signal according to an operation amount on the right side from the neutral position of the left operation lever 73, and outputs the operation signal to the controller 100.

Similarly, the right-side work operation device 2*b* has a right operation lever 74 including an operation lever capable of being operated in the front-rear direction and the left-right direction, and fifth to eighth potentiometers 65 to 68. The fifth potentiometer 65 generates an operation signal according to an operation amount on the front side from a neutral position of the right operation lever 74, and outputs the operation signal to the controller 100. The sixth potentiometer 66 generates an operation signal according to an operation amount on the rear side from the neutral position of the right operation lever 74, and outputs the operation signal to the controller 100. The seventh potentiometer 67 generates an operation signal according to an operation amount on the left side from the neutral position of the right operation lever 74, and outputs the operation signal to the controller 100. The eighth potentiometer 68 generates an operation signal according to an operation amount on the right side from the neutral position of the right operation lever 74, and outputs the operation signal to the controller 100.

The controller 100 generates a command current according to an operation signal from the first potentiometer 61, and outputs the command current to a solenoid section of the swing solenoid proportional valve 41*a*, to drive the swing solenoid proportional valve 41*a*. The swing solenoid proportional valve 41*a* reduces the delivery pressure of the pilot pump 27 to generate a pilot pressure, and applies the pilot pressure to an operation section on one side of the swing directional control valve 23 through a pilot line P5, to drive a spool of the swing directional control valve 23 toward the other side. As a result, hydraulic fluid from the hydraulic pump 8*c* is supplied through the swing directional control valve 23 to the swing motor 4, so that the swing motor 4 is rotated in one direction.

In addition, the controller 100 generates a command current according to an operation signal from the second potentiometer 62, and outputs the command current to a solenoid section of the swing solenoid proportional valve 41*b*, to drive the swing solenoid proportional valve 41*b*. The swing solenoid proportional valve 41*b* reduces the delivery pressure of the pilot pump 27 to generate a pilot pressure, and applies the pilot pressure to an operation section on the other side of the swing directional control valve 23 through a pilot line P6, to drive the spool of the swing directional control valve 23 toward one side. As a result, hydraulic fluid from the hydraulic pump 8*c* is supplied through the swing directional control valve 23 to the swing motor 4, so that the swing motor 4 is rotated in an opposite direction.

Note that the pilot lines P5 and P6 are provided with swing pressure sensors 31*a* and 31*b*, and actual pilot pressures detected by the pressure sensors are inputted to the controller 100.

The controller 100 generates a command current according to an operation signal from the third potentiometer 63, and outputs the command current to solenoid sections of the arm solenoid proportional valves 43*a* and 43*b*, to drive the arm solenoid proportional valves 43*a* and 43*b*. The arm solenoid proportional valve 43*a* reduces the delivery pressure of the pilot pump 27 to generate a pilot pressure, and applies the pilot pressure to an operation section on one side of the arm directional control valve 25*a* through a pilot line P11, to drive a spool of the arm directional control valve 25*a* toward the other side. The arm solenoid proportional valve 43*b* reduces the delivery pressure of the pilot pump 27 to generate a pilot pressure, and applies the pilot pressure to an operation section on one side of the arm directional control valve 25*b* through a pilot line P12, to drive a spool of the arm directional control valve 25*b* toward the other side. As a result, hydraulic fluid from the hydraulic pump 8*b* is supplied to a rod side of the arm cylinder 6 through the arm directional control valve 25*a*, and hydraulic fluid from the hydraulic pump 8*c* is supplied to the rod side of the arm cylinder 6 through the arm directional control valve 25*b*, so that the arm cylinder 6 is contracted.

In addition, the controller 100 generates a command current according to an operation signal from the fourth potentiometer 64, and outputs the command current to solenoid sections of the arm solenoid proportional valves 43*c* and 43*d*, to drive the arm solenoid proportional valves 43*c* and 43*d*. The arm solenoid proportional valve 43*c* reduces the delivery pressure of the pilot pump 27 to generate a pilot pressure, and applies the pilot pressure to an operation section on the other side of the arm directional control valve 25*a* through a pilot line P13, to drive the spool of the arm directional control valve 25*a* toward one side. The arm solenoid proportional valve 43*d* reduces the delivery pressure of the pilot pump 27 to generate a pilot pressure, and applies the pilot pressure to an operation section on the other side of the arm directional control valve 25*b* through a pilot line P14, to drive the spool of the arm directional control valve 25*b* toward one side. As a result, hydraulic fluid from the hydraulic pump 8*b* is supplied to a bottom side of the arm cylinder 6 through the arm directional control valve 25*a*, and hydraulic fluid from the hydraulic pump 8*c* is supplied to the bottom side of the arm cylinder 6 through the arm directional control valve 25*b*, so that the arm cylinder 6 is extended.

Note that the pilot lines P11, P12, P13, and P14 are provided with arm pressure sensors 33*a*, 33*b*, 33*c*, and 33*d*, and actual pilot pressures detected by the pressure sensors are inputted to the controller 100.

The controller 100 generates a command current according to an operation signal from the fifth potentiometer 65, and outputs the command current to solenoid sections of the boom solenoid proportional valves 42*a* and 42*b*, to drive the boom solenoid proportional valves 42*a* and 42*b*. The boom solenoid proportional valve 42*a* reduces the delivery pressure of the pilot pump 27 to generates a pilot pressure, and applies the pilot pressure to an operation section on one side of the boom directional control valve 24*a* through a pilot line P7, to drive a spool of the boom directional control valve 24*a* toward the other side. The boom solenoid proportional valve 42*b* reduces the delivery pressure of the pilot pump 27 to generate a pilot pressure, and applies the pilot pressure to an operation section on one side of the boom directional control valve 24*b* through a pilot line P8, to drive a spool of the boom directional control valve 24*b* toward the other side. As a result, hydraulic fluid from the hydraulic pump 8*a* is supplied to a rod side of the boom cylinder 5 through the boom directional control valve 24*a*, and hydraulic fluid from the hydraulic pump 8*b* is supplied to the rod side of the boom cylinder 5 through the boom directional control valve 24*b*, so that the boom cylinder 5 is contracted.

In addition, the controller 100 generates a command current according to an operation signal from the sixth potentiometer 66, and outputs the command current to solenoid sections of the boom solenoid proportional valves 42*c* and 42*d*, to drive the boom solenoid proportional valves 42*c* and 42*d*. The boom solenoid proportional valve 42*c* reduces the delivery pressure of the pilot pump 27 to generate a pilot pressure, and applies the pilot pressure to an operation section on the other side of the boom directional control valve 24*a* through a pilot line P9, to drive the spool of the boom directional control valve 24*a* toward one side. The boom solenoid proportional valve 42*d* reduces the delivery pressure of the pilot pump 27 to generate a pilot pressure, and applies the pilot pressure to an operation section on the other side of the boom directional control valve 24*b* through a pilot line P10, to drive the spool of the boom directional control valve 24*b* toward one side. As a result, hydraulic fluid from the hydraulic pump 8*a* is supplied to a bottom side of the boom cylinder 5 through the boom directional control valve 24*a*, and hydraulic fluid from the hydraulic pump 8*b* is supplied to the bottom side of the boom cylinder 5 through the boom directional control valve 24*b*, so that the boom cylinder 5 is extended.

Note that the pilot lines P7, P8, P9, and P10 are provided with boom pressure sensors 32*a*, 32*b*, 32*c*, and 32*d*, and actual pilot pressures detected by the pressure sensors are inputted to the controller 100.

The controller 100 generates a command current according to an operation signal from the seventh potentiometer 67, and outputs the command signal to a solenoid section of the bucket solenoid proportional valve 44*a*, to drive the bucket solenoid proportional valve 44*a*. The bucket solenoid proportional valve 44*a* reduces the delivery pressure of the pilot pump 27 to generate a pilot pressure, and applies the pilot pressure to an operation section on one side of the bucket directional control valve 26 through a pilot line P15, to drive a spool of the bucket directional control valve 26 toward the other side. As a result, hydraulic fluid from the hydraulic pump 8*a* is supplied to a bottom side of the bucket cylinder 7 through the bucket directional control valve 26, so that the bucket cylinder 7 is extended.

In addition, the controller 100 generates a command current according to an operation signal from the eighth potentiometer 68, and outputs the command current to a solenoid section of the bucket solenoid proportional valve 44*b*, to drive the bucket solenoid proportional valve 44*b*. The bucket solenoid proportional valve 44*b* reduces the delivery pressure of the pilot pump 27 to generate a pilot pressure, and applies the pilot pressure to an operation section on the other side of the bucket directional control valve 26 through a pilot line P16, to drive the spool of the bucket directional control valve 26 toward one side. As a result, hydraulic fluid from the hydraulic pump 8*a* is supplied to a rod side of the bucket cylinder 7 through the bucket directional control valve 26, so that the bucket cylinder 7 is contracted.

Note that the pilot lines P15 and P16 are provided with bucket pressure sensors 34*a* and 34*b*, and actual pilot pressures detected by the pressure sensors are inputted to the controller 100.

Based on the command current of each solenoid proportional valve and the actual pilot pressure detected by the pressure sensor on a secondary side thereof, the controller 100 determines whether or not an abnormal state is generated in the solenoid proportional valve. In the case where it is determined that an abnormal state is generated in the solenoid proportional valve, the controller 100 causes the abnormal state of the solenoid proportional valve to be displayed on a display device 50, to inform the operator.

A relief valve 28 is provided on a delivery side of the pilot pump 27. The relief valve 28 prescribes an upper limit value for the delivery pressure of the pilot pump 27. A gate lock valve 29 is provided between the pilot pump 27, and the first to fourth pilot valves 45 to 48 and the solenoid proportional valves 41*a*, 41*b*, 42*a* to 42*d*, 43*a* to 43*d*, 44*a*, and 44*b* mentioned above.

In the case where the gate lock lever 16 is operated to a raised position (lock position), a switch is opened, and a solenoid section of the gate lock valve 29 is not excited, so that the gate lock valve 29 is brought into a neutral position on a lower side in the figure. As a result, supply of hydraulic fluid from the pilot pump 27 to the first to fourth pilot valves 45 to 48 and the solenoid proportional valves 41*a*, 41*b*, 42*a* to 42*d*, 43*a* to 43*d*, 44*a*, and 44*b* mentioned above is interrupted. Therefore, the hydraulic actuators become inoperable. On the other hand, in the case where the gate lock lever 16 is operated to a lowered position (unlock position), the switch is closed, and the solenoid section of the gate lock valve 29 is excited, so that the gate lock valve 29 is brought into a switching position on an upper side in the figure. As a result, hydraulic fluid is supplied from the pilot pump 27 to the first to fourth pilot valves 45 to 48 and the solenoid proportional valves 41*a*, 41*b*, 42*a* to 42*d*, 43*a* to 43*d*, 44*a*, and 44*b* mentioned above, so that the hydraulic actuators 3*a*, 3*b*, and 4 to 7 become operable.

Figure 3:
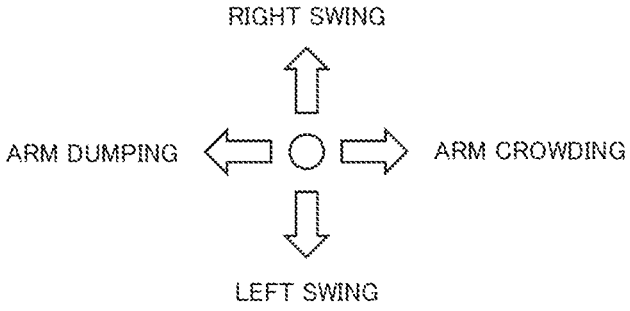
FIG. 3 is a diagram depicting operation patterns of a left operation lever in the first embodiment of the present invention.

FIG. 3 is a diagram depicting operation patterns of the left operation lever 73.

In FIG. 3, a rightward lever operation of the left operation lever 73 corresponds to an operation of pulling the arm 18 toward the operator's side (arm crowding), and a leftward lever operation corresponds to an operation of pushing out the arm 18 toward the far side (arm dumping). In addition, an upward lever operation corresponds to an operation of swinging the upper swing structure 11 rightward, and a downward lever operation corresponds to an operation of swinging the upper swing structure 11 leftward.

Figure 4:
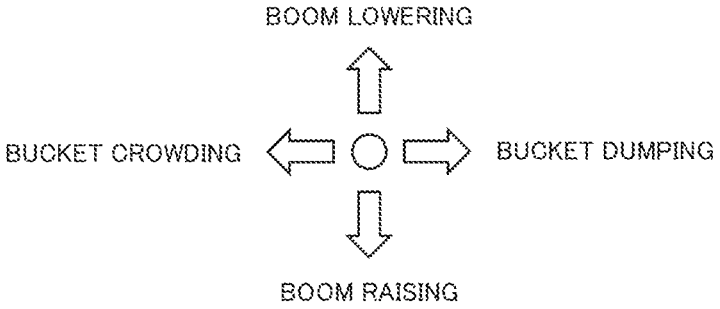
FIG. 4 is a diagram depicting operation patterns of a right operation lever in the first embodiment of the present invention.

FIG. 4 is a diagram depicting operation patterns of the right operation lever 74.

In FIG. 4, a rightward lever operation of the right operation lever 74 corresponds to an operation of pushing out the bucket 19 toward the far side (hereinafter referred to as bucket dumping), and a leftward lever operation corresponds to an operation of pulling the bucket 19 toward the operator's side (hereinafter referred to as bucket crowding). In addition, an upward lever operation corresponds to an operation of lowering the boom 17, and a downward lever operation corresponds to an operation of raising the boom 17. Hereinafter, responsiveness of the bucket 19 (bucket crowding and bucket dumping) will be described, unless specified otherwise. In that case, the rightward lever operation will be referred to as a positive direction, and the leftward lever operation will be referred to as a negative direction.

Figure 5:
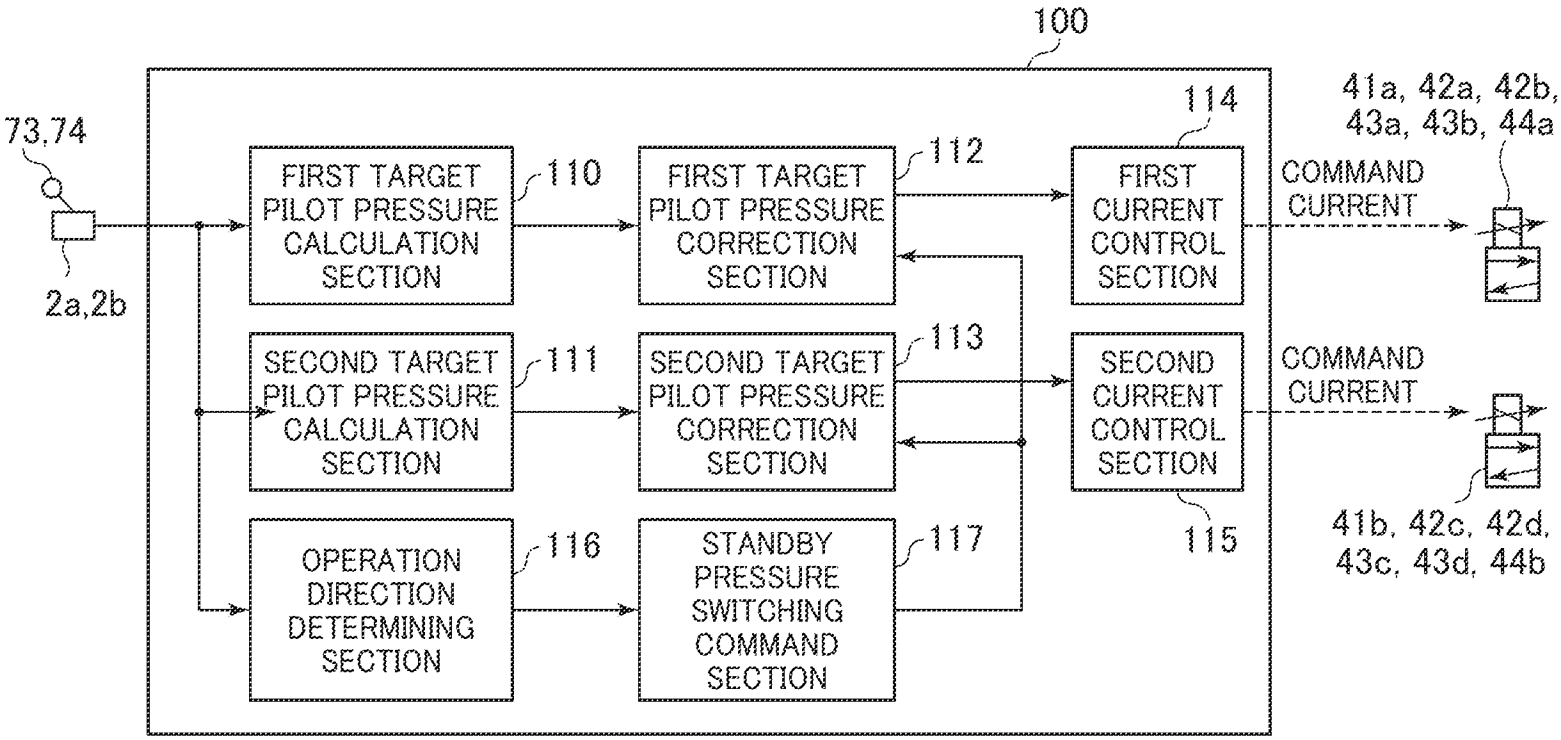
FIG. 5 is a block diagram depicting a functional configuration of a controller in the first embodiment of the present invention.
Figure 6:
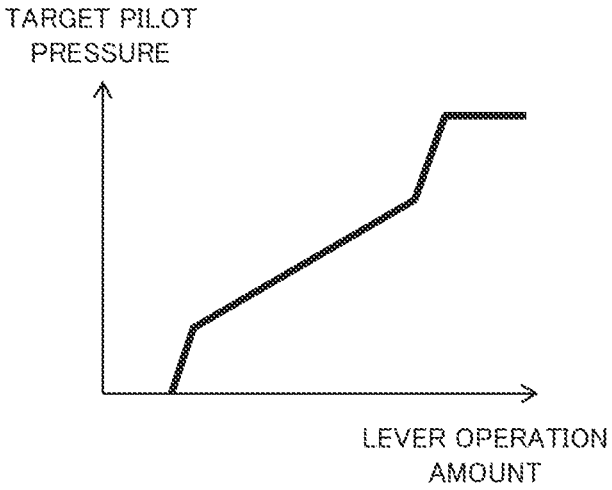
FIG. 6 is a diagram depicting an example of correlation between a lever operation amount and a target pilot pressure in the first embodiment of the present invention.
Figure 7:
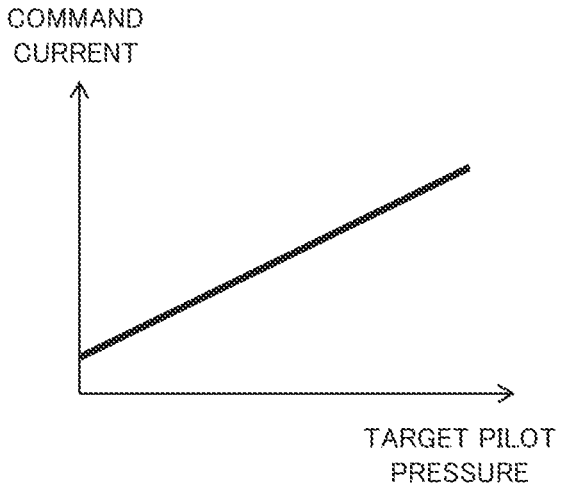
FIG. 7 is a diagram depicting an example of correlation between the target pilot pressure and a command current outputted to a solenoid proportional valve in the first embodiment of the present invention.
Figure 8:
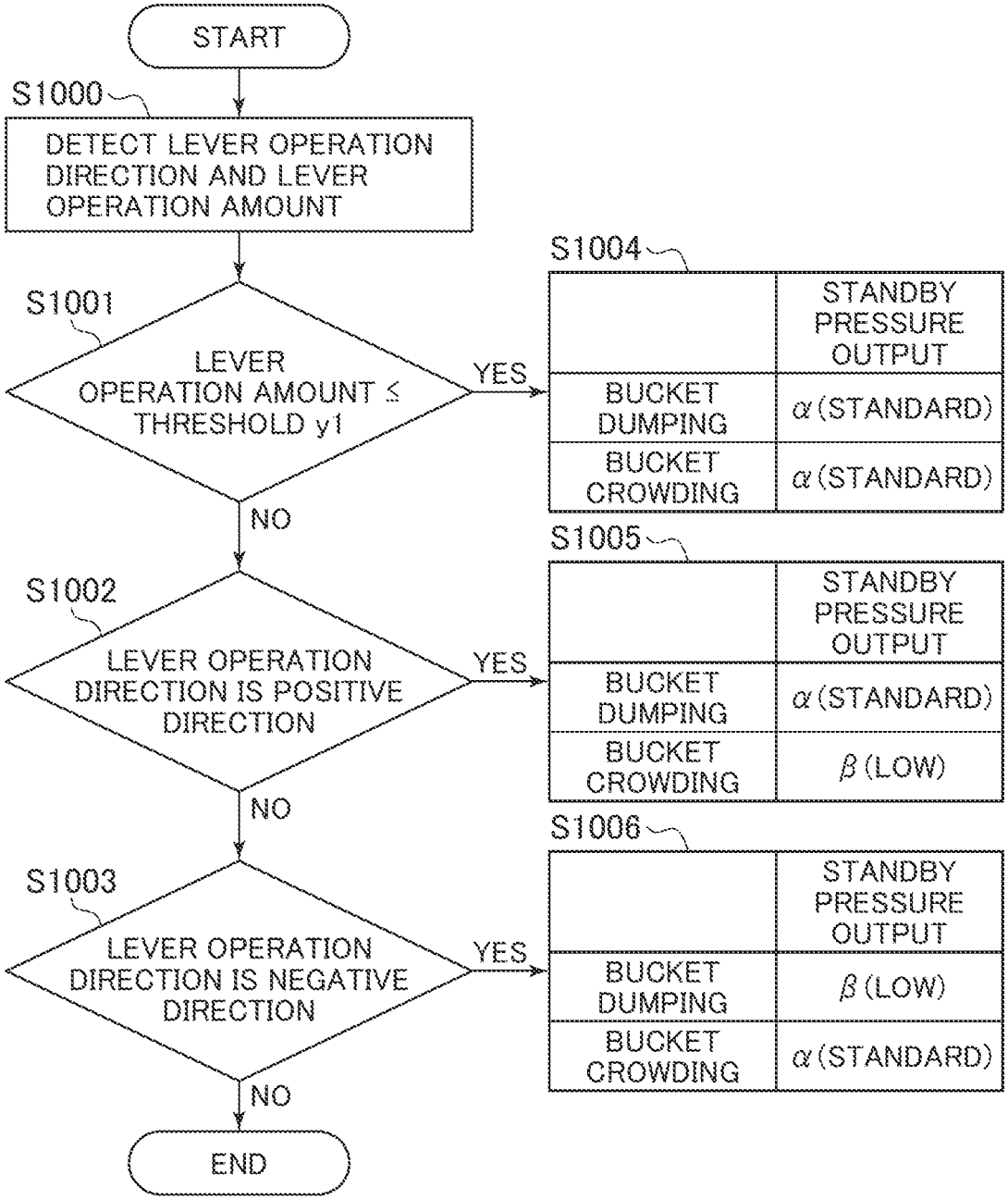
FIG. 8 is a flow chart depicting a standby pressure correction procedure for a bucket solenoid proportional valve in a standby pressure switching command section in the first embodiment of the present invention.
Figure 9:
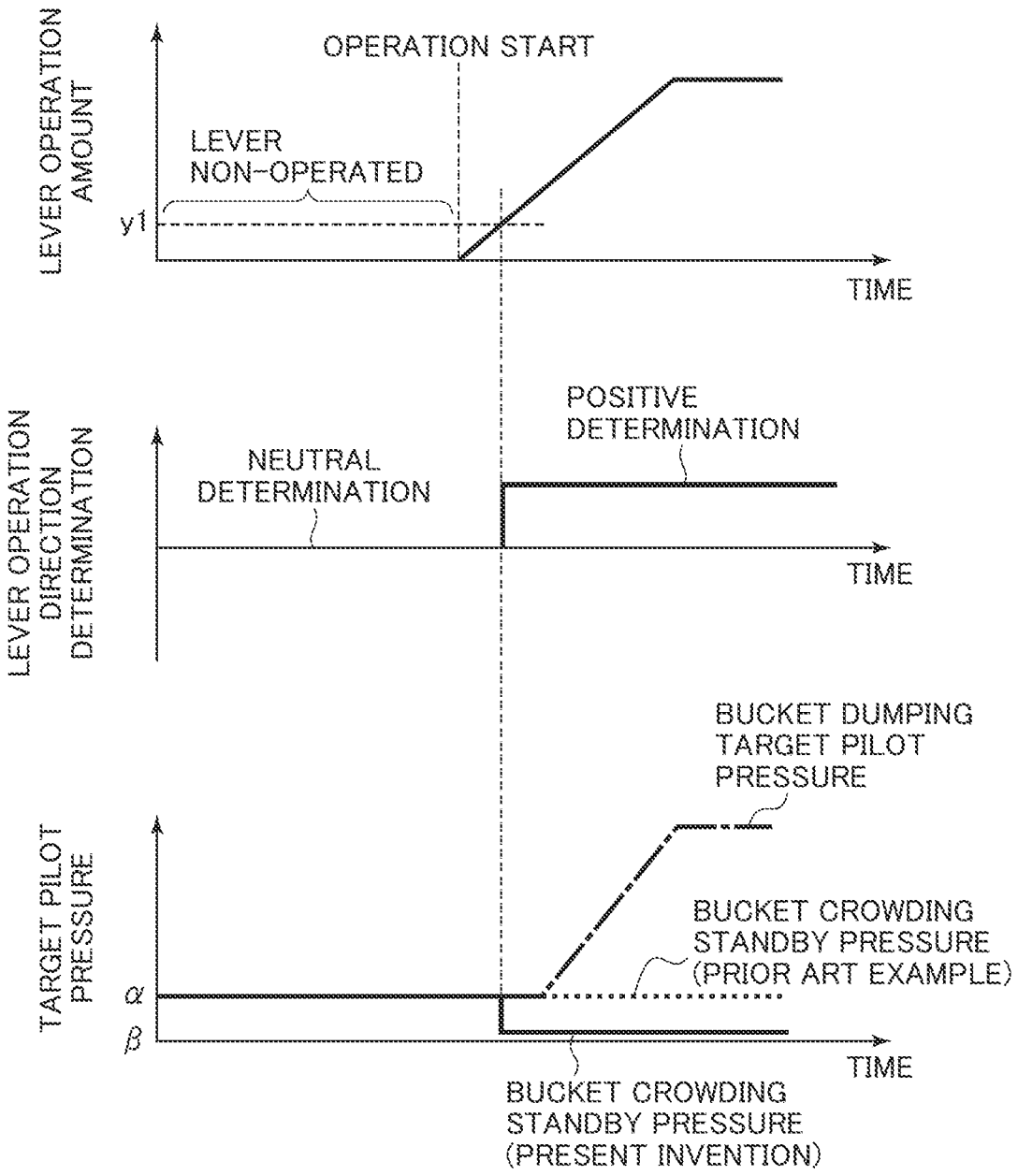
FIG. 9 is a diagram depicting an example of a standby pressure correcting method when the right operation lever is operated in a positive direction in the first embodiment of the present invention.
Figure 10:
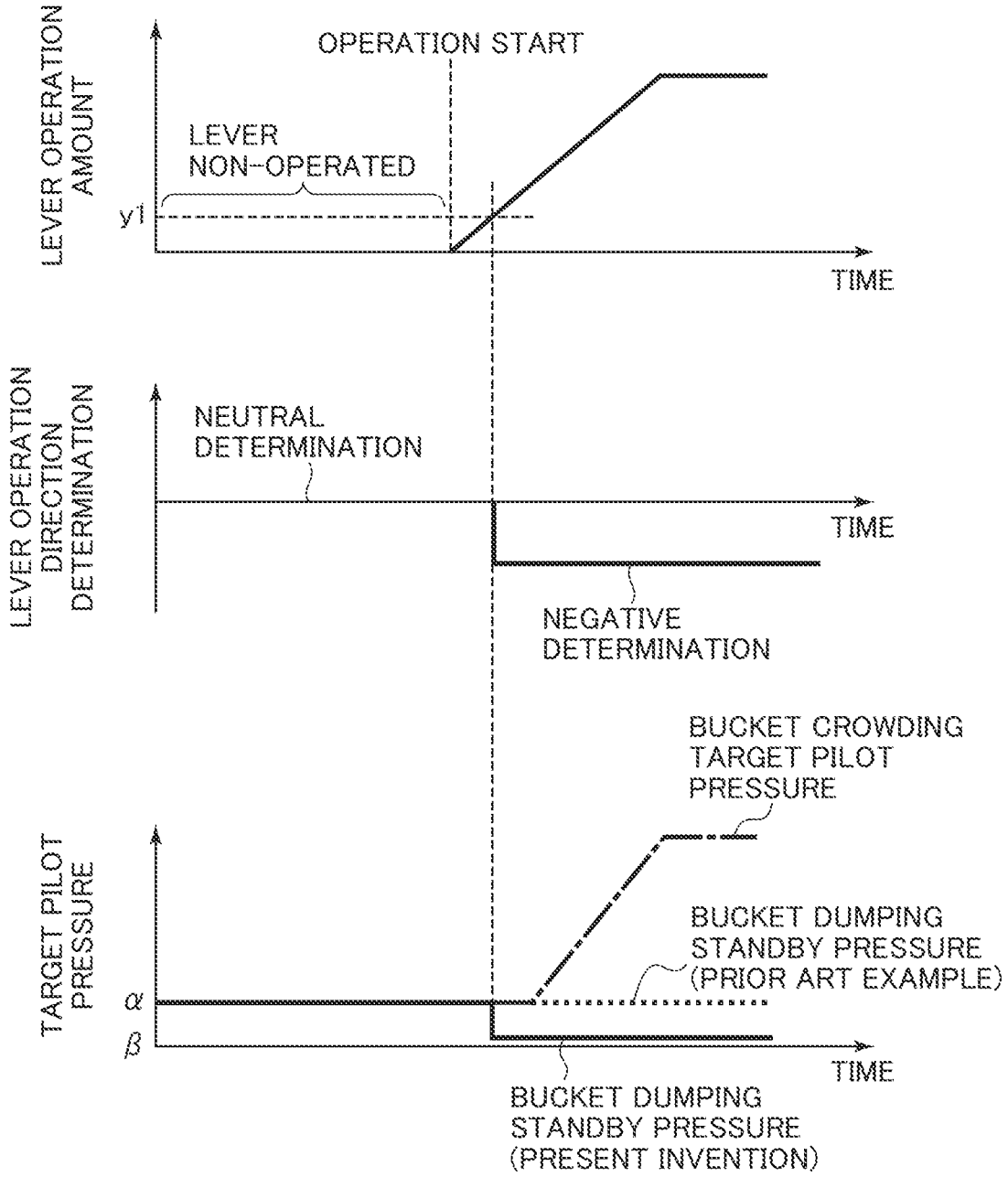
FIG. 10 is a diagram depicting an example of a standby pressure correcting method when the right operation lever is operated in a negative direction in the first embodiment of the present invention.

Next, details of the controller 100 which is an essential part in the first embodiment will be described. In the present invention, paying attention to the lever operation direction, a standby pressure of a solenoid proportional valve in a direction opposite to the lever operation is modified. FIG. 5 is a block diagram depicting a functional configuration of the controller 100 in the first embodiment; FIG. 6 is a diagram depicting one example of correlation between a lever operation amount and a target pilot pressure; FIG. 7 is a diagram depicting one example of correlation between the target pilot pressure and a command current outputted to the solenoid proportional valve; FIG. 8 is a flow chart depicting a procedure of correction of the standby pressure of the bucket solenoid proportional valves 44*a* and 44*b* in a standby pressure switching command section; FIG. 9 illustrates diagrams depicting one example of a standby pressure correcting method when the right operation lever 74 is operated in the positive direction; and FIG. 10 illustrates diagrams depicting one example of the standby pressure correcting method when the right operation lever 74 is operated in the negative direction.

Contents of processing of the controller 100 will be described using FIG. 5.

A first target pilot pressure calculation section 110 and a second target pilot pressure calculation section 111 output a target pilot pressure according to the correlation between the lever operation amount and the target pilot pressure depicted in FIG. 6.

A first target pilot pressure correction section 112 and a second target pilot pressure correction section 113 correct a target pilot pressure to a standard standby pressure (first standby pressure) a when the target pilot pressures outputted by the first and second target pilot pressure calculation sections 110 and 111 are smaller than a predetermined pressure. Here, the standard standby pressure $\alpha$ is set at a value (for example, on the order of several tens of KPa) lower than a minimum driving pressure of a directional control valve such that the directional control valve is not driven.

A first current control section 114 and a second current control section 115 convert the target pilot pressures outputted by the first and second target pilot pressure correction sections 112 and 113 to a command current based on the correlation between the target pilot pressure and the command current depicted in FIG. 7.

An operation direction determining section 116 determines the operation directions of the operation levers 73 and 74 based on operation amounts of the operation levers 73 and 74 outputted by the work operation devices 2*a* and 2*b*.

A standby pressure switching command section 117 determines a solenoid proportional valve corresponding to an actuator operation in a direction opposite to the lever operation direction, based on the operation direction outputted by the operation direction determining section 116, and outputs a standby pressure switching command to a target pilot pressure correction section corresponding to the solenoid proportional valve determined.

Next, the standby pressure correcting method of the standby pressure switching command section 117 will be described using FIG. 8.

In step S1000, a lever operation direction and a lever operation amount are detected. In step S1001, whether or not the lever operation amount is equal to or less than a threshold y1 is determined. When the lever operation amount is equal to or less than the threshold y1, the control proceeds to step S1004, in which a standard standby pressure a is outputted as standby pressures for the solenoid proportional valve 44*b* corresponding to bucket dumping and the solenoid proportional valve 44*a* corresponding to bucket crowding.

When the lever operation amount is not equal to or less than the threshold y1, the control proceeds to step S1002, in which whether or not the lever operation direction is the positive direction is determined. When the lever operation direction is the positive direction, the control proceeds to step S1005, in which the standard standby pressure α is outputted as a standby pressure for the solenoid proportional valve 44*b* corresponding to bucket dumping, and a low standby pressure (second standby pressure) β is outputted as a standby pressure for the solenoid proportional valve 44*a* corresponding to bucket crowding. Here, the low standby pressure β is set at a value (for example, on the order of several KPa) lower than the standard standby pressure α.

When the lever operation direction is not the positive direction, the control proceeds to step S1003, in which it is determined whether or not the lever operation direction is the negative direction. When the lever operation direction is the negative direction, the control proceeds to step S1006, in which the standard standby pressure α is outputted as a standby pressure for the solenoid proportional valve 44*a* corresponding to bucket crowding, and the low standby pressure β is outputted as a standby pressure for the solenoid proportional valve 44*b* corresponding to bucket dumping. When the lever operation direction is not the negative direction, the flow is finished.

Next, time series of pilot pressures for bucket crowding and bucket dumping will be described using FIGS. 9 and 10.

In FIG. 9, an example of driving the solenoid proportional valve 44*b* corresponding to bucket dumping by a lever operation is depicted. When the lever is non-operated, it is determined that the lever is neutral, and both of the solenoid proportional valves 44*a* and 44*b* corresponding to bucket crowding and bucket dumping output the standard standby pressure α. When the lever operation has been started and the lever operation amount in the positive direction (bucket dumping direction) exceeds the threshold y1, the solenoid proportional valve 44*a* corresponding to a direction (bucket crowding direction) opposite to the lever operation outputs the low standby pressure β, whereas the solenoid proportional valve 44*b* corresponding to the bucket dumping direction outputs the standard standby pressure α. When the lever operation amount further increases and the value of the target pilot pressure based on the correlation between the lever operation amount and the target pilot pressure depicted in FIG. 6 becomes higher than the standard standby pressure α, the target pilot pressure based on the correlation between the lever operation amount and the target pilot pressure is outputted.

In FIG. 10, an example of driving the solenoid proportional valve 44*a* corresponding to bucket crowding by a lever operation is depicted. When the lever is non-operated, since an operation similar to that in FIG. 9 is conducted, description thereof is omitted. When the lever operation has been started and the lever operation amount in the negative direction (bucket crowding direction) exceeds the threshold y1, the solenoid proportional valve 44*b* corresponding to the direction (bucket dumping direction) opposite to the lever operation outputs the standby pressure whereas the solenoid proportional valve 44*a* corresponding to the bucket crowding direction outputs the standard standby pressure α. When the lever operation amount further increases and the value of the target pilot pressure based on the correlation between the lever operation amount and the target pilot pressure depicted in FIG. 6 becomes higher than the standard standby pressure α, the target pilot pressure based on the correlation between the lever operation amount and the target pilot pressure is outputted.

As described above, in the first embodiment, the hydraulic excavator 200 includes: the hydraulic actuators 4 to 7; the hydraulic pilot type directional control valves 23, 24*a*, 24*b*, 25*a*, 25*b*, and 26 that control the flows of hydraulic fluid supplied to the hydraulic actuators 4 to 7; the first solenoid proportional valves 41*a*, 42*a*, 42*b*, 43*a*, 43*b*, and 44*a* that generate a pilot pressure for driving the directional control valves in one direction; the second solenoid proportional valves 41*b*, 42*c*, 42*d*, 43*c*, 43*d*, and 44*b* that generate a pilot pressure for driving the directional control valves in the other direction; the operation devices 2*a* and 2*b* for operating the hydraulic actuators 4 to 7; and the controller 100 that outputs a command current of the first solenoid proportional valves according to the first target pilot pressure which is a target pilot pressure of the first solenoid proportional valves calculated based on operation signals of the operation devices 2*a* and 2*b*, and that outputs a command current of the second solenoid proportional valves according to the second target pilot pressure which is a target pilot pressure of the second solenoid proportional valves calculated based on operation signals of the operation devices 2*a* and 2*b*. The controller 100 has the first target pilot pressure correction section 112 that corrects the first target pilot pressure to the first standby pressure α set lower than a minimum driving pressure for the directional control valves when the first target pilot pressure is lower than the first standby pressure α, and the second target pilot pressure correction section 113 that corrects the second target pilot pressure to the first standby pressure α when the second target pilot pressure is lower than the first standby pressure α. The controller 100 further has the operation direction determining section 116 that determines the operation directions of the operation devices based on the operation signals, and the standby pressure switching command section 117 that outputs a standby pressure switching command to the first target pilot pressure correction section 112 or the second target pilot pressure correction section 113 corresponding to the solenoid proportional valve not corresponding to the operation direction, from among the first solenoid proportional valves and the second solenoid proportional valves. The first target pilot pressure correction section 112 and the second target pilot pressure correction section 113 switch the first standby pressure α to a second standby pressure β set lower than the first standby pressure α when the standby pressure switching command has been inputted.

According to the hydraulic excavator 200 according to the first embodiment configured as above, the standby pressure outputted from the solenoid proportional valve not corresponding to the operation directions of the operation devices 2*a* and 2*b*, from among the first solenoid proportional valves 41*a*, 42*a*, 42*b*, 43*a*, 43*b*, and 44*a* and the second solenoid proportional valves 41*b*, 42*c*, 42*d*, 43*c*, 43*d*, and 44*b*, is switched from the first standby pressure α to the second standby pressure β set lower than the first standby pressure α when the operation devices 2*a* and 2*b* are operated. As a result, a back pressure at the time of driving the spools of the directional control valves 23, 24*a*, 24*b*, 25*a*, 25*b*, and 26 is lowered, driving of the spools becomes smoother, and responsiveness of the hydraulic actuators 4 to 7 can be enhanced.

Embodiment 2

A second embodiment of the present invention will be described, the description being focused on differences from the first embodiment.

Figure 11:
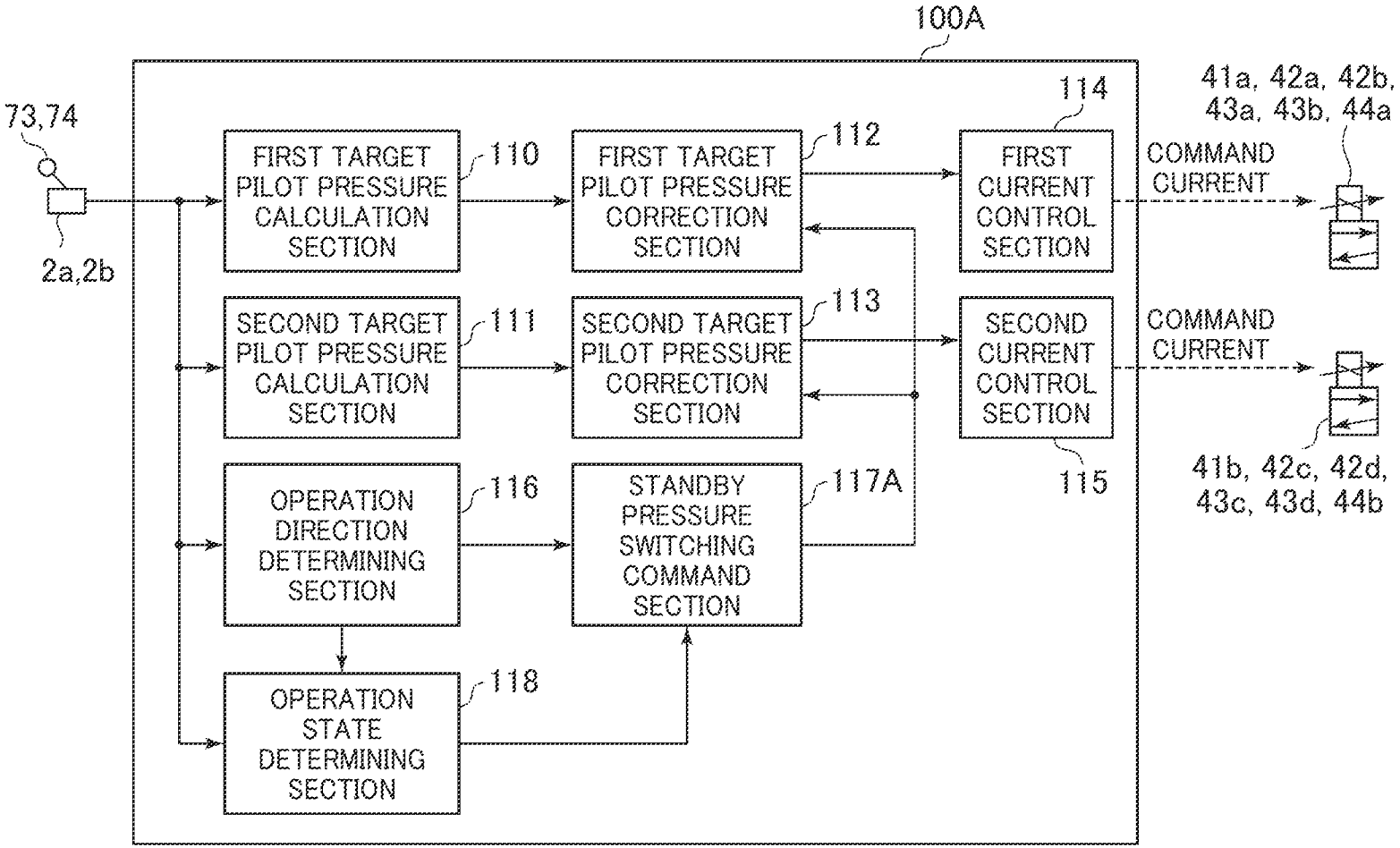
FIG. 11 is a block diagram depicting a functional configuration of a controller in a second embodiment of the present invention.
Figure 12:
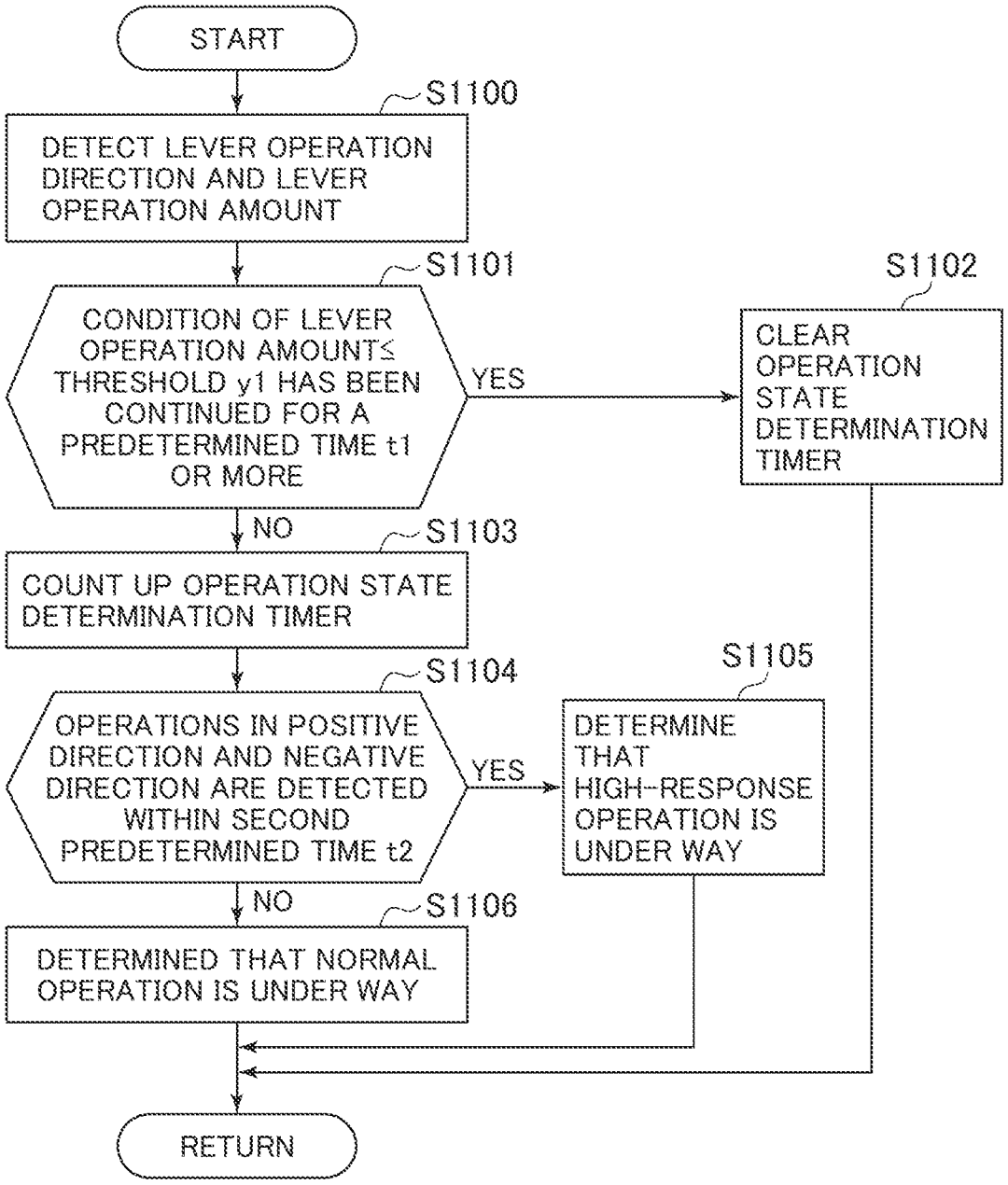
FIG. 12 is a flow chart depicting a work determining method at a work state determination section in the second embodiment of the present invention.
Figure 13:
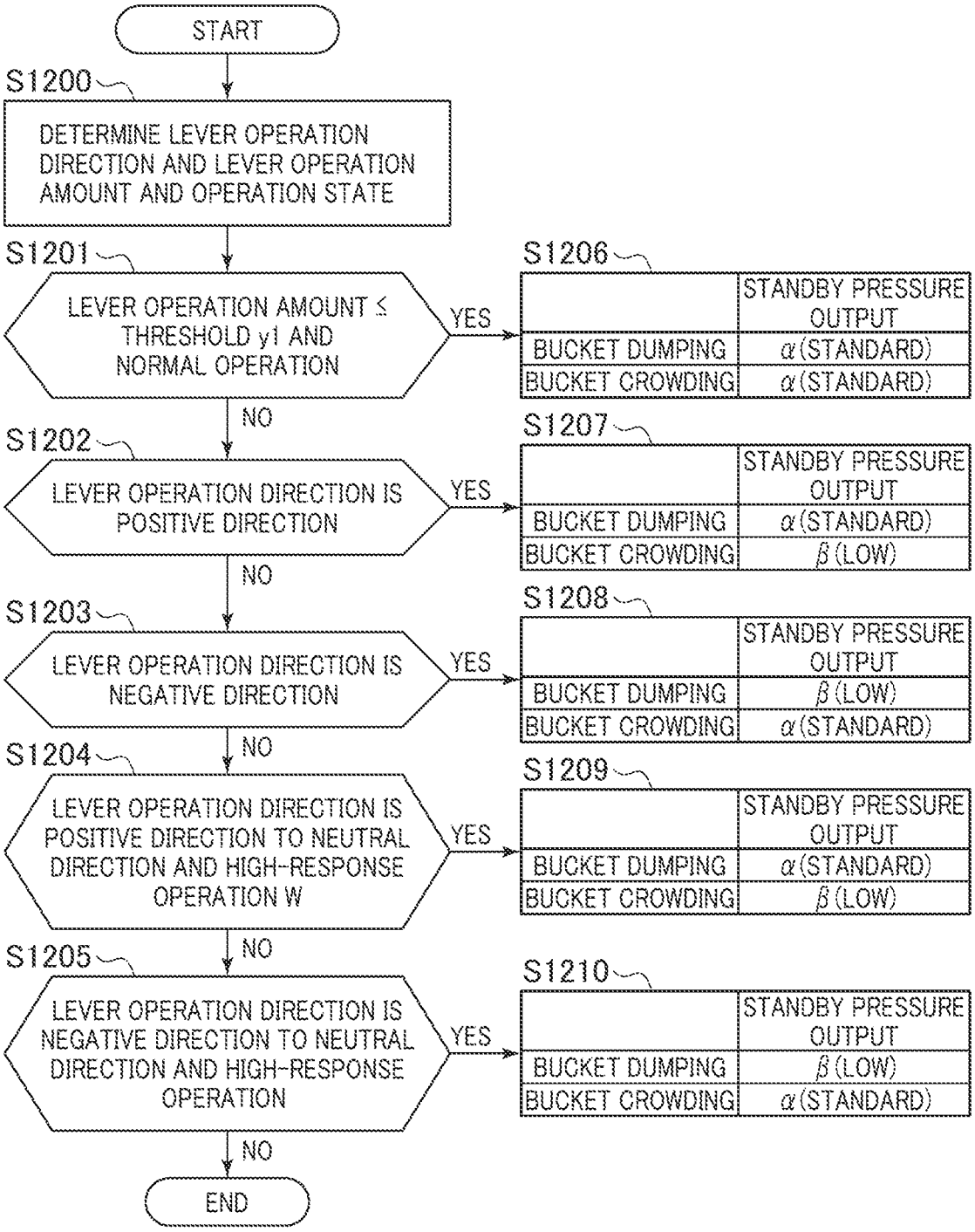
FIG. 13 is a flow chart depicting a standby pressure correction procedure at a standby pressure switching command section in the second embodiment of the present invention.
Figure 14:
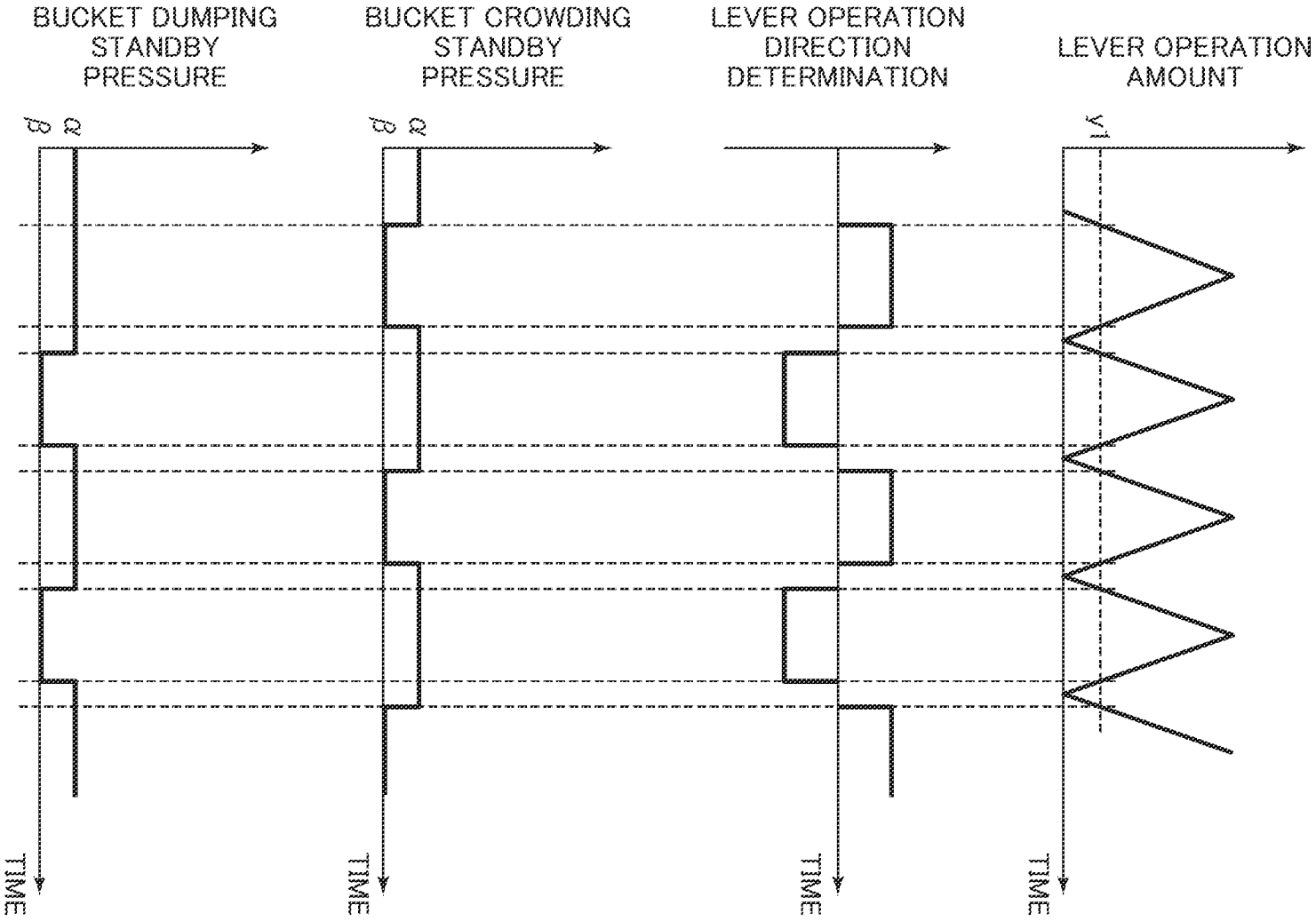
FIG. 14 is a diagram depicting an example (without a work state determining section) of a standby pressure correcting method at the time of a high-response work in the second embodiment of the present invention.
Figure 15:
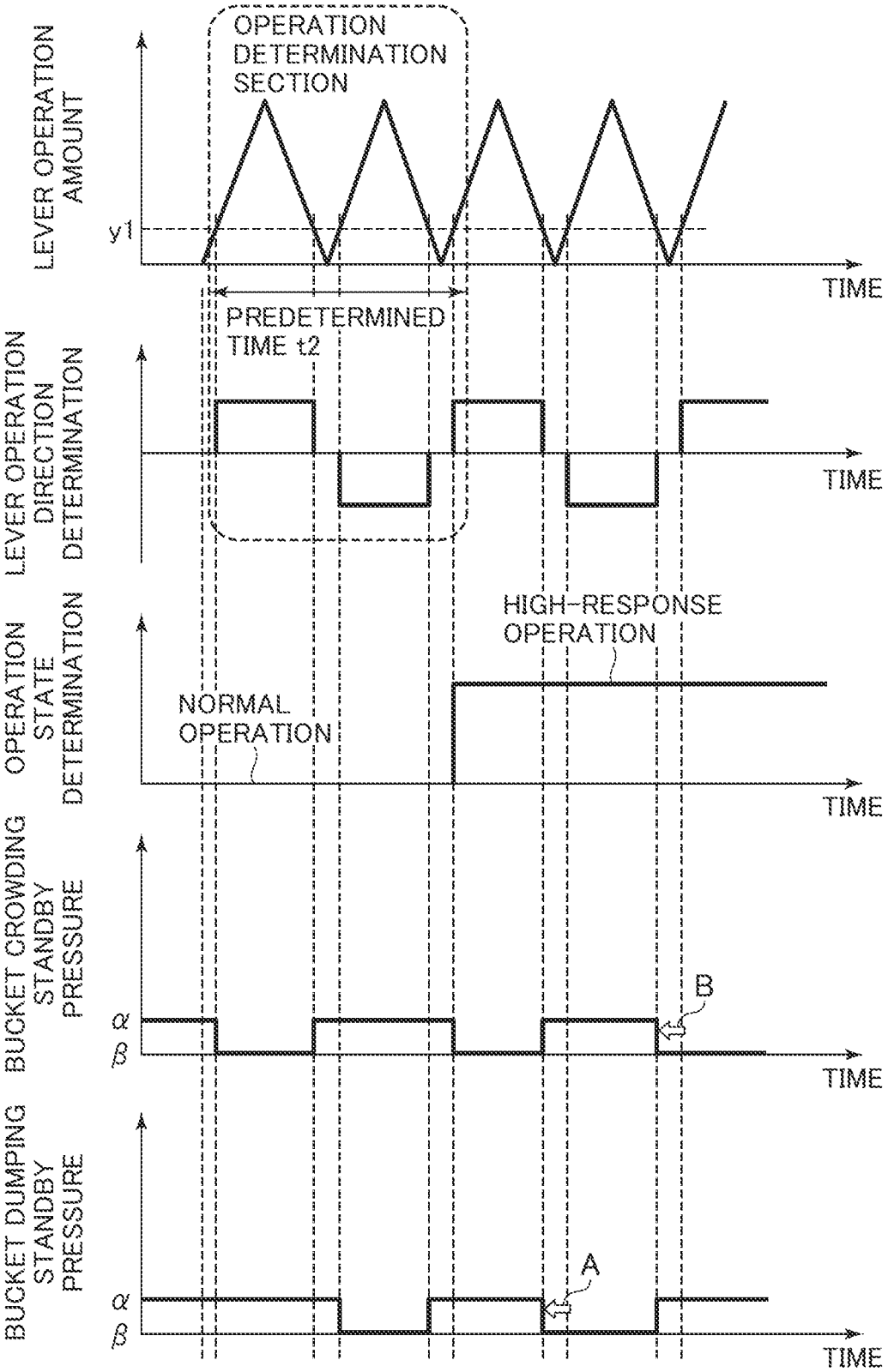
FIG. 15 is a diagram depicting an example (with a work state determining section) of a standby pressure correcting method at the time of a high-response work in the second embodiment of the present invention.

FIG. 11 is a block diagram depicting a functional configuration of a controller in the second embodiment; FIG. 12 is a flow chart depicting a work determining method in a work state determining section; FIG. 13 is a flow chart depicting a correction procedure for standby pressures of the bucket solenoid proportional valves 44*a* and 44*b* of a standby pressure switching command section in the second embodiment; FIG. 14 is a diagram depicting one example of a standby pressure correcting method for the solenoid proportional valve 44*a* corresponding to bucket crowding and the solenoid proportional valve 44*b* corresponding to bucket dumping in the case where a work state determining section is absent (first embodiment); and FIG. 15 is a diagram depicting one example of a standby pressure correcting method for the solenoid proportional valve 44*a* corresponding to bucket crowding and the solenoid proportional valve 44*b* corresponding to bucket dumping in the case where the work state determining section is provided.

Contents of processing of a controller 100A will be described using FIG. 11. The difference from the first embodiment (depicted in FIG. 5) is in that a work state determining section 118 is provided which determines a work state from a lever operation amount, and that a standby pressure switching command for the solenoid proportional valve 44*a* corresponding to bucket crowding or the solenoid proportional valve 44*b* corresponding to bucket dumping is outputted according to a work state outputted by the work state determining section 118 and an operation direction outputted by the operation direction determining section 116.

Next, a work state determining method of the work state determining section 118A will be described using FIG. 12. Note that other work than a high-response work will be referred to as a normal work, unless specified otherwise.

In step S1100, a lever operation direction and a lever operation amount are detected. In step S1101, it is determined whether or not a state in which the lever operation amount is equal to or less than a threshold y1 has been continued for a first predetermined time t1 or more. When the state of equal to or less than the threshold y1 has been continued for the first predetermined time t1 or more, the control proceeds to step S1102, in which it is determined that a lever operation has not been conducted, a work state determining timer is cleared, and the flow is finished. Here, the first predetermined time t1 is set, for example, on the order of several seconds. The first predetermined time t1 is provided for distinguishing a state in which the lever is stopped in a neutral position and a state in which the lever has passed through the neutral position from each other. For example, in the case where the lever operation is operated alternately in the positive direction and in the negative direction, there is a timing at which the lever operation amount is equal to or less than the threshold y1; if the first predetermined time t1 is not provided, therefore, immediately after the lever operation amount becomes equal to or less than the threshold y1, the work state determining timer would be cleared and the lever would be regarded as being stopped in the neutral position, notwithstanding the lever is being moved.

When the state in which the lever operation amount is equal to or less than the threshold y1 has not been continued for the first predetermined time t1 or more, the control proceeds to step S1103, in which the work state determining timer is counted up. The control proceeds to step S1104, and, in the case where lever operations in the positive direction and in the negative direction are detected during a period from the time when the work state determining timer is finally cleared until a second predetermined time t2 elapses, the control proceeds to step S1105, in which it is determined that a high-response work is under way, and the flow is finished.

In the case where the lever operations in the positive direction and in the negative direction are not detected during the period from the time when the work state determining timer is set until the second predetermined time t2 elapses, the control proceeds to step S1106, in which it is determined that a normal work is under way, and the flow is finished. Here, the second predetermined time t2 is set to be shorter than the first predetermined time and be such a time that the lever can be reciprocated once between the positive direction and the negative direction (for example, on the order of several hundreds of milliseconds).

Next, a standby pressure correcting method of a standby pressure switching command section 117A will be described using FIG. 13.

In step S1200, a lever operation direction and a lever operation amount are detected. In step S1201, it is determined whether or not the lever operation amount is equal to or less than the threshold y1 and a normal operation is under way. When the lever operation amount is equal to or less than the threshold y1 and the normal operation is under way, the control proceeds to step S1206, in which a standard standby pressure $\alpha$ is outputted as standby pressures for the solenoid proportional valve 44*b* corresponding to bucket dumping and the solenoid proportional valve 44*a* corresponding to bucket crowding.

When the lever operation amount is not equal to or less than the threshold y1 or when the normal operation is not under way, the control proceeds to step S1202, in which it is determined whether or not the lever operation direction is the positive direction. When the lever operation direction is the positive direction, the control proceeds to step S1207, in which the standard standby pressure $\alpha$ is outputted as a standby pressure for the solenoid proportional valve 44*b* corresponding to bucket dumping, and a low standby pressure $\beta$ is outputted as a standby pressure for the solenoid proportional valve 44*a* corresponding to bucket crowding.

When the lever operation direction is not the positive direction, the control proceeds to step S1203, in which it is determined whether or not the lever operation direction is the negative direction. When the lever operation direction is the negative direction, the control proceeds to step S1208, in which the standard standby pressure $\alpha$ is outputted as a standby pressure for the solenoid proportional valve 44*a* corresponding to bucket crowding, and the low standby pressure $\beta$ is outputted as a standby pressure for the solenoid proportional valve 44*b* corresponding to bucket dumping.

When the lever operation direction is not the negative direction, the control proceeds to step S1204, in which it is determined whether or not the lever operation direction has been returned from the positive direction to a neutral direction and a high-response work is under way. When the lever operation direction has been returned from the positive direction to the neutral direction and the high-response work is under way, the control proceeds to step S1209, in which the standard standby pressure α is outputted as a standby pressure for the solenoid proportional valve 44*b* corresponding to bucket dumping, and the low standby pressure β is outputted as a standby pressure for the solenoid proportional valve 44*a* corresponding to bucket crowding.

When the lever operation direction has not been returned from the positive direction to the neutral direction or when the high-response work is not under way, the control proceeds to step S1205, in which it is determined whether or not the lever operation direction has been returned from the negative direction to the neutral direction and the high-response work is under way. When the lever operation direction has been returned from the negative direction to the neutral direction and the high-response work is under way, the standard standby pressure α is outputted as a standby pressure for the solenoid proportional valve 44*a* corresponding to bucket crowding, and the low standby pressure β is outputted as a standby pressure for the solenoid proportional valve 44*b* corresponding to bucket dumping. When the lever operation direction has not been returned from the negative direction to the neutral direction or when the high-response work is not under way, the flow is finished.

Next, variation in time series of standby pressure in the case where the work state determining section 118A is present and in the case where the work state determining section 118A is absent will be described using FIGS. 14 and 15.

First, the case where the work state determining section 118A is absent (first embodiment) will be described using FIG. 14. In the case where the work state determining section 118A is absent, when the lever operation direction is the positive direction (bucket dumping direction), the standby pressure for the solenoid proportional valve 44*a* corresponding to the negative direction (bucket crowding direction) is switched from the first standby α to the second standby β, whereas when the lever operation direction is the negative direction (bucket crowding direction), the standby pressure for the solenoid proportional valve 44*b* corresponding to the negative direction (bucket dumping direction) is switched from the first standby α to the second standby β. In other words, the standby pressure is switched according only to the lever operation direction.

Next, the case where the work state determining section 118A is present will be described using FIG. 15. In the case where the work state determining section 118A is present, work determination is started at the time when the lever operation amount exceeds the threshold y1 for the first time. In the case where operations in the positive direction (bucket dumping direction) and in the negative direction (bucket crowding direction) are detected within the second predetermined time t2, it is determined that the high-response work is under way. During the high-response work, a supposition that the lever operation direction will transit to the negative direction (bucket crowding direction) is made when the lever operation direction transits from the positive direction (bucket dumping direction) to the neutral direction (equal to or less than the lever operation threshold y1), and the standby pressure for the solenoid proportional valve 44*b* corresponding to a direction opposite to the supposed lever operation direction, namely, corresponding to the positive direction (bucket dumping direction) is switched to the low standby pressure β. In other words, during the high-response work, the timing at which the standby pressure in the bucket crowding direction is switched from the standard standby pressure α to the low standby pressure β is advanced, as indicated by arrow A in the figure.

A similar operation to the above is conducted also when the lever is in the opposite direction. A supposition that the lever operation direction will transit to the positive direction (bucket dumping direction) is made when the lever operation direction transits from the negative direction (bucket crowding direction) to the neutral direction (equal to or less than the lever operation threshold y1), and the standby pressure for the solenoid proportional valve 44*a* corresponding to a direction opposite to the supposed lever operation direction, namely, corresponding to the negative direction (bucket crowding direction) is switched to the low standby pressure β. In other words, during the high-response work, the timing at which the standby pressure in the bucket dumping direction is switched from the standard standby pressure α to the low standby pressure β is advanced, as indicated by arrow B in the figure.

In this way, the controller 100A in the second embodiment further has the work state determining section 118 that determines the work state based on variation in the operation amounts of the operation devices 2*a* and 2*b*, and the first target pilot pressure correction section 112 and the second target pilot pressure correction section 113 advance the timing for switching the first standby pressure α to the second standby pressure β, according to the work state.

According to the hydraulic excavator 200 according to the second embodiment configured as above, the timing at which the standby pressure outputted from the solenoid proportional valve not corresponding to the operation directions of the operation devices 2*a* and 2*b* is lowered from the first standby pressure α to the second standby pressure β is advanced, according to the work state, so that the responsiveness of the hydraulic actuators 4 to 7 can be enhanced more than in the first embodiment.

Embodiment 3

A third embodiment of the present invention will be described, the description being focused on differences from the first embodiment.

Work machines such as hydraulic excavators are used in a variety of environments, and their uses in a site below the freezing point may also be supposed. In general, the viscosity of an oil increases as the temperature of the oil (hereinafter referred to as oil temperature) is lowered. When the viscosity of an oil increases, the oil comes to flow with difficulty, and the responsiveness of the directional control valves 23, 24*a*, 24*b*, 25*a*, 25*b*, and 26 is worsened. The third embodiment is intended to realize improvement of the response delay of the directional control valves 23, 24*a*, 24*b*, 25*a*, 25*b*, and 26 when the oil temperature is low.

Figure 16:
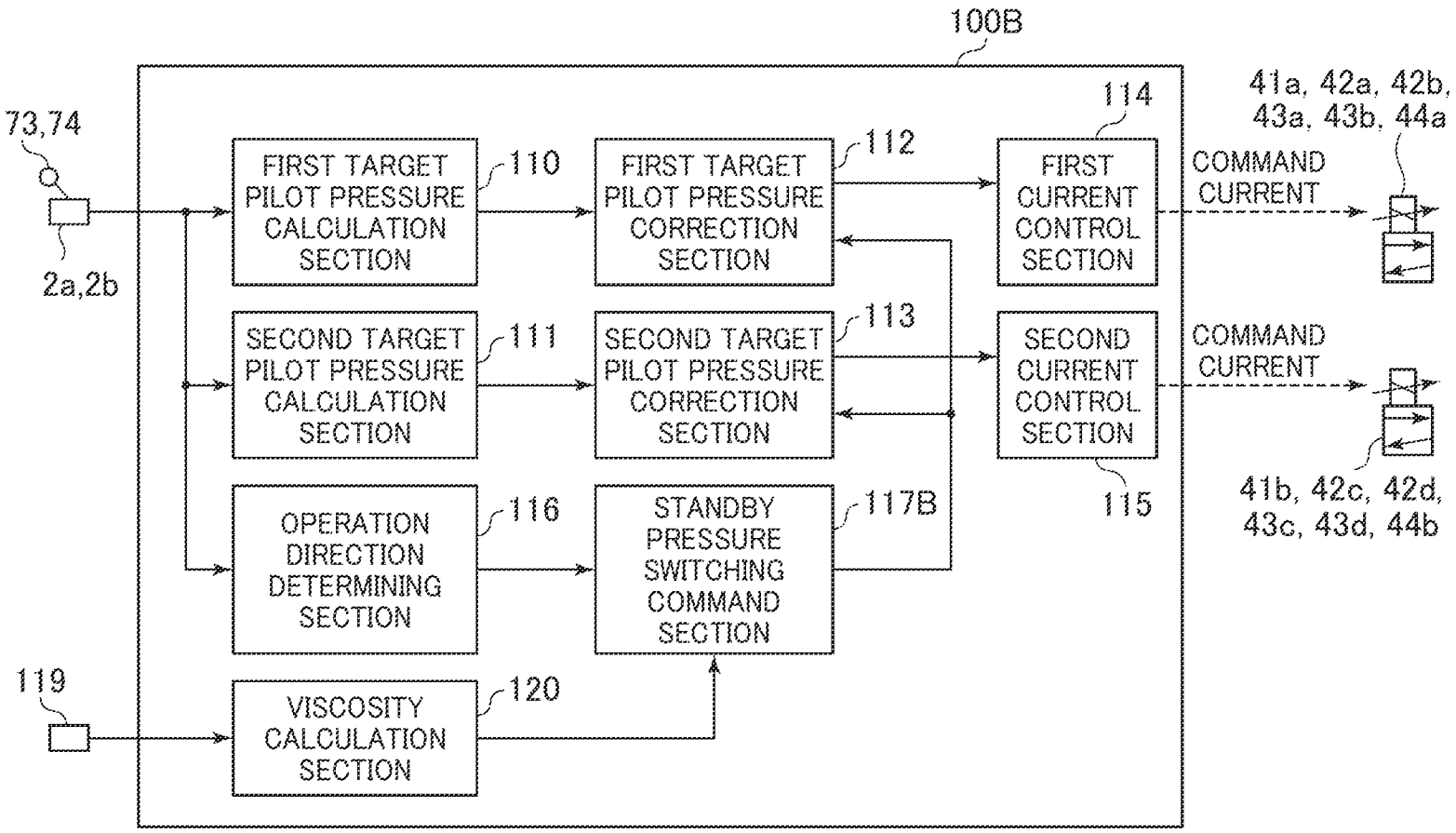
FIG. 16 is a block diagram depicting a functional configuration of a controller in a third embodiment of the present invention.
Figure 17:
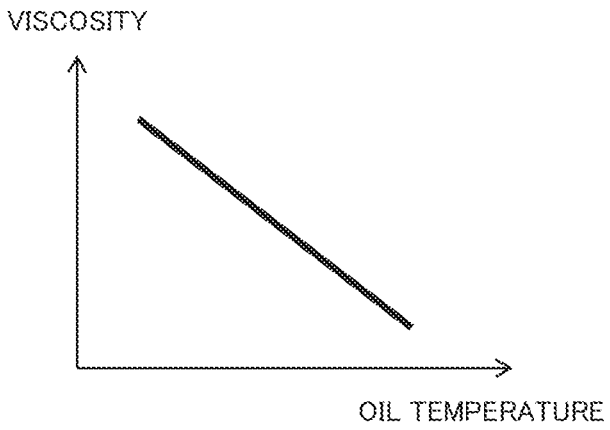
FIG. 17 is a diagram depicting an example of correlation between oil temperature and viscosity in the third embodiment of the present invention.
Figure 18:
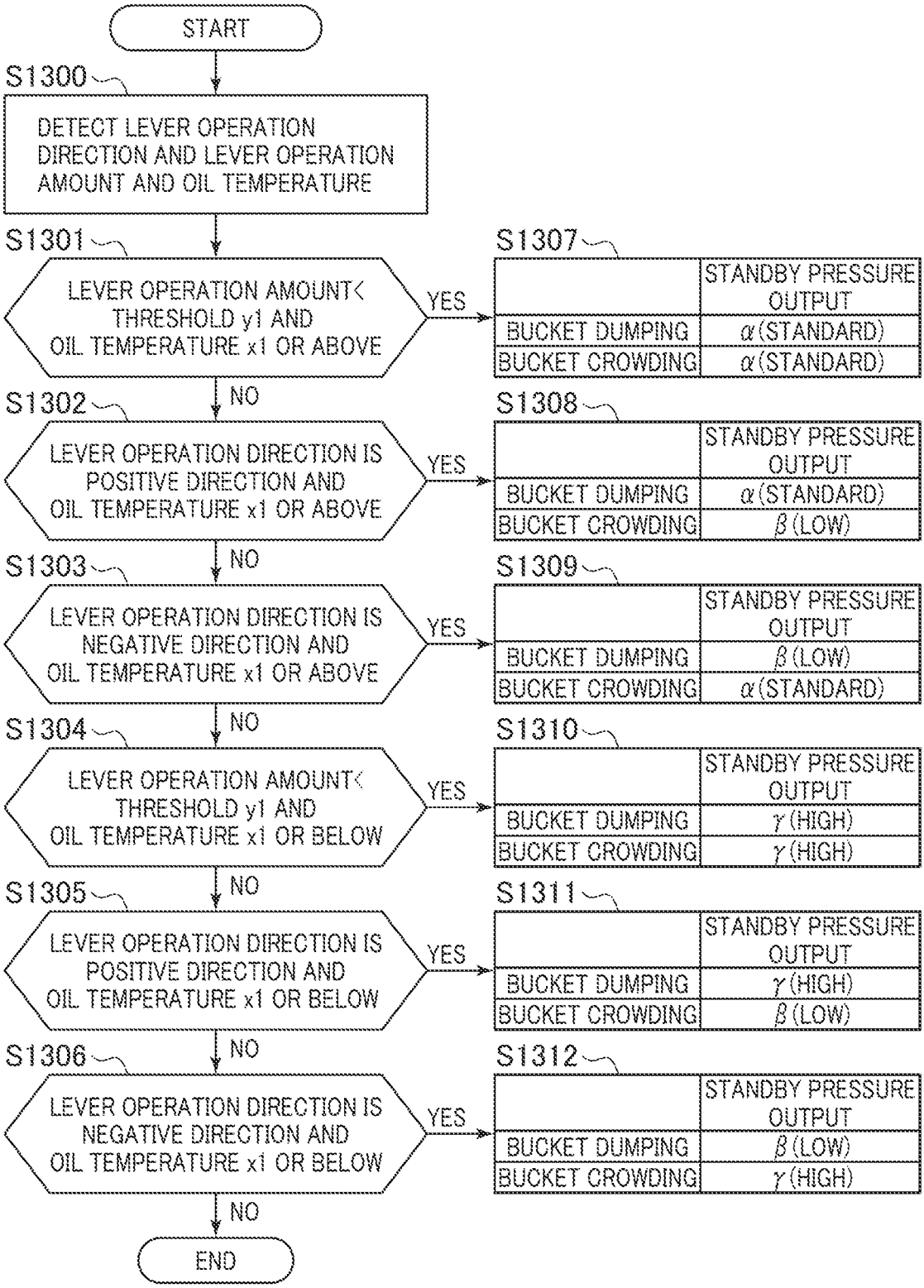
FIG. 18 is a flow chart depicting a standby pressure correction procedure at a standby pressure switching command section in the third embodiment of the present invention.
Figure 19:
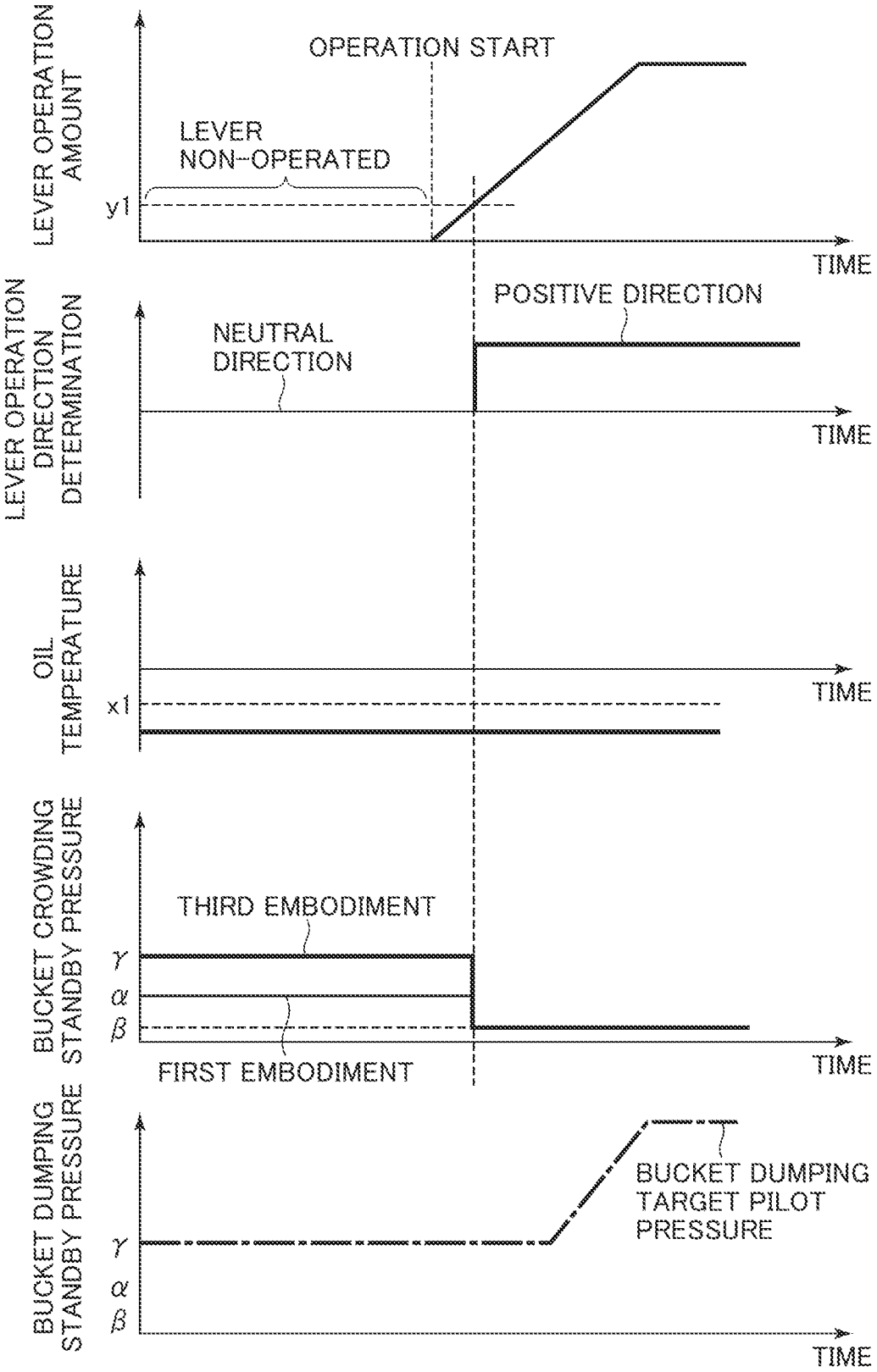
FIG. 19 is a diagram depicting an example of a standby pressure correcting method when a lever is operated in a positive direction in the third embodiment of the present invention.

Details of a controller 100B in the third embodiment will be described. FIG. 16 is a block diagram depicting a functional configuration of the controller 100B in the third embodiment; FIG. 17 is a diagram depicting one example of correlation between the oil temperature and the oil viscosity; FIG. 18 is a flow chart depicting a correcting procedure for standby pressures of the bucket solenoid proportional valves 44*a* and 44*b* of a standby pressure switching command section in the third embodiment; and FIG. 19 is a diagram depicting one example of a standby pressure correcting method when the lever is operated in the positive direction.

First, the functional configuration of the controller 100B in the third embodiment will be described using FIG. 16. The difference from the first and second embodiments is that the controller 100B further has an oil temperature sensor 119 that detects the temperature of a hydraulic working fluid (hereinafter referred to as oil temperature), and an oil viscosity calculation section 120 that calculates the viscosity from the correlation between the oil temperature and the viscosity depicted in FIG. 17, based on the oil temperature detected by the oil temperature sensor 119, and that a standby pressure switching command section 117B outputs a standby pressure switching command for the solenoid proportional valve 44*a* corresponding to bucket crowding and the solenoid proportional valve 44*b* corresponding to bucket dumping, according to the lever operation direction outputted by the operation direction determining section 116 and the viscosity outputted by the oil viscosity calculation section 120.

Next, a standby pressure correcting method of the standby pressure switching command section 117B will be described using FIG. 18.

In step S1300, a lever operation direction and a lever operation amount are detected. In step S1301, it is determined whether or not the lever operation amount is equal to or less than a threshold y1 and the oil temperature is x1 (for example, 0° C.) or above. When the lever operation amount is equal to or less than the threshold y1 and the oil temperature is x1 or above, the control proceeds to step S1307, in which a standard standby pressure α is outputted as standby pressures for the solenoid proportional valve 44*b* corresponding to bucket dumping and the solenoid proportional valve 44*a* corresponding to bucket crowding.

When the lever operation amount is not equal to or less than the threshold y1 or when the oil temperature is not x1 or above, the control proceeds to step S1302, in which it is determined whether or not the lever operation direction is the positive direction and the oil temperature is x1 or above. When the lever operation direction is the positive direction and the oil temperature is x1 or above, the control proceeds to step S1308, in which the standard standby pressure α is outputted as a standby pressure for the solenoid proportional valve 44*b* corresponding to bucket dumping, and a low standby pressure β is outputted as a standby pressure for the solenoid proportional valve 44*a* corresponding to bucket crowding.

When the lever operation direction is not the positive direction or when the oil temperature is not x1 or above, the control proceeds to step S1303, in which it is determined whether or not the lever operation direction is the negative direction and the oil temperature is x1 or above. When the lever operation direction is the negative direction and the oil temperature is x1 or above, the control proceeds to step S1309, in which the standard standby pressure α is outputted as a standby pressure for the solenoid proportional valve 44*a* corresponding to bucket crowding, and the low standby pressure β is outputted as a standby pressure for the solenoid proportional valve 44*b* corresponding to bucket dumping.

When the lever operation direction is not the negative direction or when the oil temperature is not x1 or above, the control proceeds to step S1304, in which it is determined whether or not the lever operation amount is equal to or less than the threshold y1 and the oil temperature is x1 or below. When the lever operation amount is equal to or less than the threshold y1 and the oil temperature is x1 or below, the control proceeds to step S1310, in which a high standby pressure (third standby pressure) γ is outputted as standby pressures for the solenoid proportional valve 44*b* corresponding to bucket dumping and the solenoid proportional valve 44*a* corresponding to bucket crowding. Here, the high standby pressure γ is set to be lower than a minimum driving pressure (on the order of several MPa) for the directional control valves and to be a value (for example, on the order of several hundreds of KPa to several MPa) higher than the standard standby pressure α.

When the lever operation amount is not equal to or less than the threshold y1 or when the oil temperature is not x1 or below, the control proceeds to step S1305, in which it is determined whether or not the lever operation direction is the positive direction and the oil temperature is x1 or below. When the lever operation direction is the positive direction and the oil temperature is x1 or below, the control proceeds to step S1311, in which the first standby pressure γ is outputted as a standby pressure for the solenoid proportional valve 44*b* corresponding to bucket dumping, whereas the low standby pressure β is outputted as a standby pressure for the solenoid proportional valve 44*a* corresponding to bucket crowding.

When the lever operation direction is not the positive direction or when the oil temperature is not x1 or below, the control proceeds to step S1306, in which it is determined whether or not the lever operation direction is the negative direction and the oil temperature is x1 or below. When the lever operation direction is the negative direction and the oil temperature is x1 or below, the control proceeds to step S1312, in which the first standby pressure γ is outputted as a standby pressure for the solenoid proportional valve 44*a* corresponding to bucket crowding, whereas the low standby pressure β is outputted as a standby pressure for the solenoid proportional valve 44*b* corresponding to bucket dumping. When the lever operation direction is not the negative direction or when the oil temperature is not x1 or below, the flow is finished.

Next, time series of pilot pressures in bucket crowding and bucket dumping will be described using FIG. 19.

When the oil temperature is the predetermined temperature x1 or below, when the lever is non-operated, the lever is determined to be neutral, and both of the solenoid proportional valves 44*a* and 44*b* corresponding to bucket crowding and bucket dumping output the high standby pressure γ.

When the lever operation has been started and the lever operation amount in the positive direction (bucket dumping direction) exceeds the threshold y1, the solenoid proportional valve 44*a* corresponding to a direction (bucket crowding direction) opposite to the lever operation outputs the low standby pressure β, whereas the solenoid proportional valve 44*b* corresponding to the bucket dumping direction outputs the high standby pressure γ.

When the lever operation amount further increases and the value of a target pilot pressure based on correlation between the lever operation amount and the target pilot pressure depicted in FIG. 6 becomes higher than the high standby pressure γ, the target pilot pressure based on the correlation between the lever operation amount and the target pilot pressure is outputted.

Thus, the hydraulic excavator 200 according to the third embodiment further includes the oil temperature sensor (oil temperature sensor) 119 that detects the oil temperature, the controller 100B further has the oil viscosity calculation section 120 that calculates the viscosity of the hydraulic working fluid based on the oil temperature, and the first target pilot pressure correction section 112 and the second target pilot pressure correction section 113 switch the first standby pressure α to the third standby pressure γ, which is set to be lower than the minimum driving pressure of the directional control valves and be higher than the first standby pressure α, when the viscosity is higher than a predetermined value and when a standby pressure switching command has not been inputted from the standby pressure switching command section 117B.

Also in the hydraulic excavator 200 according to the third embodiment configured as above, an effect similar to that in the first embodiment can be achieved.

In addition, since the pilot pressure outputted from the solenoid proportional valve corresponding to the operation directions of the operation devices 2*a* and 2*b* rises from the first standby pressure α to the third standby pressure γ when the viscosity of the hydraulic working fluid is higher than a predetermined value, the response delay of the directional control valves 23, 24*a*, 24*b*, 25*a*, 25*b*, and 26 when the oil temperature is low can be restrained.

While the embodiments of the present invention have been described in detail above, the present invention is not limited to the above embodiments, but includes various modifications. For example, the above embodiments have been described in detail for explaining the present invention in an easily understandable manner, and are not necessarily limited to those which include all the described configurations. In addition, to the configuration of an embodiment may be added to a part of the configuration of another embodiment, or a part of the configuration of an embodiment may be deleted or may be replaced by a part of another embodiment.

DESCRIPTION OF REFERENCE CHARACTERS

1*a*, 1*b*: Track operation device
2*a*, 2*b*: Work operation device (operation device)
3*a*: Left track motor
3*b*: Right track motor
4: Swing motor (hydraulic actuator)
5: Boom cylinder (hydraulic actuator)
6: Arm cylinder (hydraulic actuator)
7: Bucket cylinder (hydraulic actuator)
8*a*, 8*b*, 8*c*: Hydraulic pump
9*a*, 9*b*, 9*c*: Regulator
10: Lower track structure
11: Upper swing structure
12: Work device
13*a*, 13*b*: Track device
14: Cab
15: Engine
16: Gate lock lever
17: Boom
18: Arm
19: Bucket
20: Control valve
20*a*, 20*b*, 20*c*: Valve group
21: Left track directional control valve
22: Right track directional control valve
23: Swing directional control valve
24*a*, 24*b*: Boom directional control valve
25*a*, 25*b*: Arm directional control valve
26: Bucket directional control valve
27: Pilot pump
28: Relief valve
29: Gate lock valve
31*a*, 31*b*: Swing pressure sensor
32*a*, 32*b*, 32*c*, 32*d*: Boom pressure sensor
33*a*, 33*b*, 33*c*, 33*d*: Arm pressure sensor
34*a*, 34*b*: Bucket pressure sensor
41*a*, 41*b*: Swing solenoid proportional valve
42*a*, 42*b*, 42*c*, 42*d*: Boom solenoid proportional valve
43*a*, 43*b*, 43*c*, 43*d*: Arm solenoid proportional valve
44*a*, 44*b*: Bucket solenoid proportional valve
45, 46, 47, 48: Pilot valve
50: Display device
61, 62, 63, 64, 65, 66, 67, 68: Potentiometer
71: Left track lever
72: Right track lever
73: Left operation lever
74: Right operation lever
100, 100A, 100B: Controller
110: First target pilot pressure calculation section
111: Second target pilot pressure calculation section
112: first target pilot pressure correction section
113: second target pilot pressure correction section
114: First current control section
115: Second current control section
116: Operation direction determining section
117, 117A, 117B: Standby pressure switching command section
118: Work state determining section
119: Oil temperature sensor
120: Viscosity calculation section
200: Hydraulic excavator (work machine)
300: Drive system
301: Main hydraulic control circuit
302: Pilot pressure control circuit

The invention claimed is:

1. A work machine comprising:

a hydraulic actuator;

a hydraulic pilot type directional control valve that controls a flow of hydraulic fluid supplied to the hydraulic actuator;

a first solenoid proportional valve that generates a pilot pressure for driving the directional control valve in one direction;

a second solenoid proportional valve that generates a pilot pressure for driving the directional control valve in another direction;

an operation device for operating the hydraulic actuator; and a controller that outputs a command current for the first solenoid proportional valve according to a first target pilot pressure as a target pilot pressure for the first solenoid proportional valve calculated based on an operation signal from the operation device, and outputs a command current for the second solenoid proportional valve according to a second target pilot pressure as a target pilot pressure for the second solenoid proportional valve calculated based on an operation signal from the operation device;

the controller including a first target pilot pressure correction section configured to correct the first target pilot pressure to a first standby pressure set to be lower than a minimum driving pressure for the directional control valve in a case in which the first target pilot pressure is lower than the first standby pressure, and a second target pilot pressure correction section configured correct the second target pilot pressure to the first standby pressure in a case in which the second target pilot pressure is lower than the first standby pressure, wherein the controller further includes:

an operation direction determining section configured to determine an operation direction of the operation device based on the operation signal; and a standby pressure switching command section configured to output a standby pressure switching command to the first target pilot pressure correction section or the second target pilot pressure correction section corresponding to the solenoid proportional valve not corresponding to the operation direction, from among the first solenoid proportional valve and the second solenoid proportional valve; and the first target pilot pressure correction section and the second target pilot pressure correction section are configured to switch the first standby pressure to a second standby pressure set to be lower than the first standby pressure in a case in which the standby pressure switching command has been inputted.

2. The work machine according to claim 1, wherein the controller further includes a work state determining section configured to determine a work state based on a variation in the operation signal, and the first target pilot pressure correction section and the second target pilot pressure correction section are configured to advance a timing for switching the first standby pressure to the second standby pressure according to the work state.

3. The work machine according to claim 1, wherein the work machine further comprises an oil temperature sensor that detects oil temperature, and the controller further includes an oil viscosity calculation section configured to calculate viscosity of a hydraulic working fluid based on the oil temperature, and the first target pilot pressure correction section and the second target pilot pressure correction section are configured to switch the first standby pressure to a third standby pressure set to be lower than the minimum driving pressure for the directional control valve and to be higher than the first standby pressure in a case in which the viscosity is higher than a predetermined value and the standby pressure switching command has not been inputted.

* * * * *